US006065889A

United States Patent [19]

Maruyama et al.

[11] Patent Number: 6,065,889

[45] Date of Patent: May 23, 2000

[54] SIDE-KNOCK TYPE MECHANICAL PENCIL

[75] Inventors: Shigeki Maruyama, Misato; Souji Onuki, Tokyo, both of Japan

[73] Assignee: Pentel Kabushiki Kaisha, Japan

[21] Appl. No.: 08/875,454

[22] PCT Filed: Jan. 26, 1996

[86] PCT No.: PCT/JP96/00139

§ 371 Date: Jul. 29, 1997

§ 102(e) Date: Jul. 29, 1997

[87] PCT Pub. No.: WO96/23666

PCT Pub. Date: Aug. 8, 1996

[30] Foreign Application Priority Data

| | | | |
|---|---|---|---|
| Jan. 30, 1995 | [JP] | Japan | 7-033065 |
| Feb. 28, 1995 | [JP] | Japan | 7-064843 |
| Mar. 31, 1995 | [JP] | Japan | 7-100762 |
| Mar. 31, 1995 | [JP] | Japan | 7-100763 |
| Apr. 27, 1995 | [JP] | Japan | 7-127173 |
| May 30, 1995 | [JP] | Japan | 7-155306 |
| Nov. 30, 1995 | [JP] | Japan | 7-336159 |
| Nov. 30, 1995 | [JP] | Japan | 7-336163 |

[51] Int. Cl.[7] ..... B43K 21/16

[52] U.S. Cl. ..... 401/65; 401/99

[58] Field of Search ..... 401/65, 99, 49, 401/55, 66, 67

[56] References Cited

U.S. PATENT DOCUMENTS

| | | | |
|---|---|---|---|
| 5,139,356 | 8/1992 | Shimada | 401/99 X |
| 5,791,797 | 8/1998 | Kageyama et al. | 401/52 |

FOREIGN PATENT DOCUMENTS

| | | | |
|---|---|---|---|
| 1020256 | 11/1957 | Germany | 401/65 |
| 3514012 | 4/1986 | Germany | 401/99 |
| 52-12489 | 3/1977 | Japan . | |
| 55-171577 | 12/1980 | Japan . | |
| 3264397 | 11/1991 | Japan | 401/99 |

*Primary Examiner*—David J. Walczak
*Attorney, Agent, or Firm*—Adams & Wilks

[57] ABSTRACT

A side-knock type mechanical pencil comprises a barrel having a front end, a rear end a lead feeding mechanism disposed in the barrel for axial movement within the barrel to feed a pencil lead toward the front end of the barrel. A knock button is disposed in a side portion of the barrel so that the knock button can be pressed inward in a radial direction of the barrel to move the lead feeding mechanism axially within the barrel to thereby feed the pencil lead toward the front end of the barrel. A lead passageway is disposed in the barrel for passing therethrough the pencil lead in a direction toward the front end of the barrel. The lead passageway has a diameter at least twice as large as a diameter of the pencil lead. At least one lead receiving member is disposed in the barrel between the lead passageway and the knock button for receiving the pencil lead. The lead receiving member has a lead insertion hole for permitting the pencil lead to pass therethrough and a head portion having an external diameter approximately equal to an internal diameter of the barrel.

38 Claims, 18 Drawing Sheets

SIDE-KNOCK TYPE MECHANICAL PENCIL

BACKGROUND OF THE INVENTION

1. Field of the Invention

The present invention relates to a side-knock type mechanical pencil in which a lead feeding mechanism is disposed in an inside portion of a barrel and a knock button is disposed in a side portion of the barrel so that the knock button can be pressed inward in a radial direction of the barrel, and the knock button is pressed to move the lead feeding mechanism back and forth, thereby feeding a lead from the barrel.

2. Background Art

Japanese Utility Model Laid-Open No. 55-171577/1980 is known as one example of a side-knock type mechanical pencil. This publication describes a head and a side-knock type mechanical pencil in which an internal tube provided with a mouth ring at its lower end and shorter than an external barrel is movably accommodated in the external barrel; an internal mechanism return spring and engaging means for projecting the mouth ring from the lower end of the external barrel and retracting the mouth ring into the external barrel are provided in the external barrel; an external hole is provided in proximity to a gripping index of the external barrel; an internal hole is provided in the portion of the internal tube which corresponds to the external hole; a lead case, a joint pipe and a three-split chuck are integrally accommodated in the internal tube; a fastener is provided inside the mouth ring and outside the three-split chuck which projects from the internal tube; a slider which causes the three-split chuck to move in the internal tube toward a lead point and is restored by a spring is provided in the internal tube; a side-knock button which can press downward the inclined surface of the upper end of the slider is provided in the external hole; and a knock cover which can press the three-split chuck toward the lead point is provided at the upper end of the lead case.

In operation, one lead is separated from the leads stored in the lead case by the upper end of the joint pipe and is then introduced into the three-split chuck through the joint pipe. The slider and the three-split chuck move forward by the radial pressure of the side-knock button, so that the lead gripped by the three-split chuck is fed forward.

In general, if the side-knock type mechanical pencil is made to carry out a lead feeding operation, i.e., if the side-knock button is pressed, the forces act on the slider not only in the forward direction thereof but also in the direction in which the side-knock button is pressed. The force which acts on the slider in the latter direction becomes a force which inclines the slider, and this force increases as the side-knock button is pressed. The inclination of the slider bends the connection portion between the joint pipe and the three-split chuck. At this time, a failure occurs in the feeding of the lead, i.e., the lead is caught by the bending so that it becomes unable to be fed in the forward direction or in a sufficient amount.

In recent years, consumers have increasingly preferred inexpensive products. It has increasingly necessary to decrease the costs of products because of higher labor costs. Writing tools, such as ball-point pens and mechanical pencils, are not exceptions, and the above-described side-knock type mechanical pencil has been forced to be inexpensively manufactured. To inexpensively manufacture the side-knock type mechanical pencil, there are a number of available methods, such as formation of two parts as one integral part, adoption of a simplified assembling method, or a reduction in the number of parts. However, the formation of two parts as one integral part makes it possible to inexpensively manufacture parts themselves, but may need a complicated and expensive forming mold in order to form a product of particular shape. For this reason, a reduction in the number of parts may be adopted. If the number of parts is reduced, the assembly becomes simple.

However, if the number of parts is simply reduced, the required functions will be lost. For example, in the case of the above-described example, if the lead case and the joint pipe are omitted, a lead may exceed the slider and enter a spring portion, so that the lead may not be gripped by the three-split chuck and may become unable to be fed forward. In addition, when the side-knock button is pressed, a lead may be broken.

SUMMARY OF THE INVENTION

According to a first aspect of the present invention, in a side-knock type mechanical pencil in which a lead feeding mechanism is disposed in an inside portion of a barrel and a knock button is disposed in a side portion of the barrel so that the knock button can be pressed inward in a radial direction of the barrel, the knock button being pressed to move the lead feeding mechanism back and forth, thereby feeding a lead from the barrel, a lead inserting portion through which the lead can pass in a direction in which the knock button applies pressure is provided, and the lead inserting portion is formed to have a diameter at least twice as large as the diameter of the lead and at least one lead receiving portion is provided forward of the lead inserting portion. According to a second aspect of the present invention, in a side-knock type mechanical pencil in which a lead feeding mechanism is disposed in an inside portion of a barrel and a knock button is disposed in a side portion of the barrel so that the knock button can be pressed inward in a radial direction of the barrel, the knock button being pressed to move the lead feeding mechanism back and forth, thereby feeding a lead from the barrel, at least one lead receiving portion is provided in a vicinity of the knock button and a lead inserting hole through which the lead can pass is provided in the lead receiving portion, and spaces each having a cross-sectional area larger than the cross-sectional area of the lead inserting portion is formed on opposite sides of the lead receiving portion.

DETAILED DESCRIPTION OF THE PREFERED EMBODIMENTS

Figure 1:
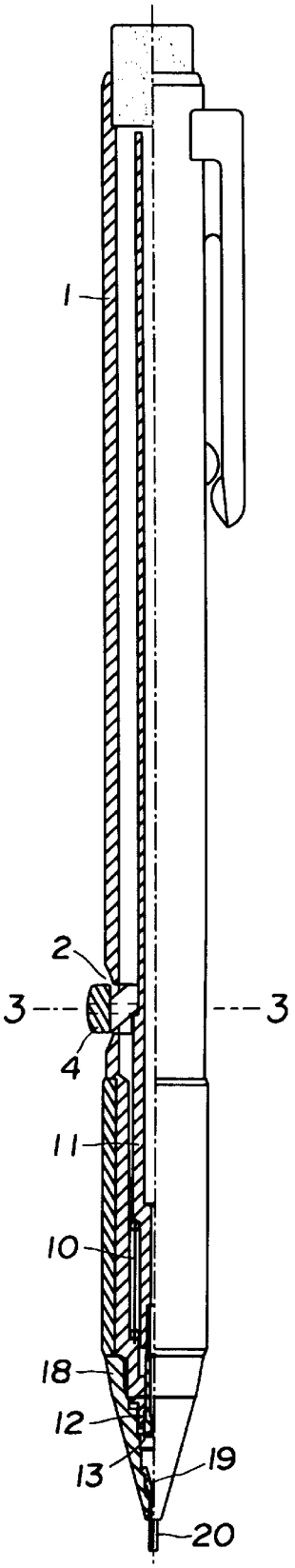
FIG. 1 is a diagrammatic longitudinal half-sectional view showing the present invention.
Figure 3:
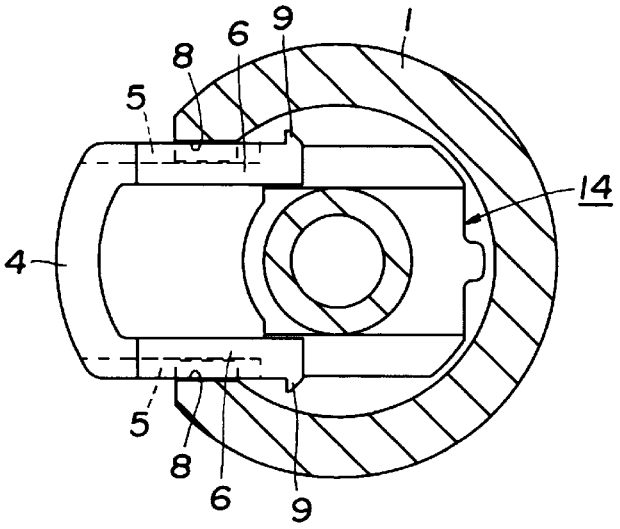
FIG. 3 is a cross-sectional view take along line 3—3 of FIG. 1.
Figure 2:
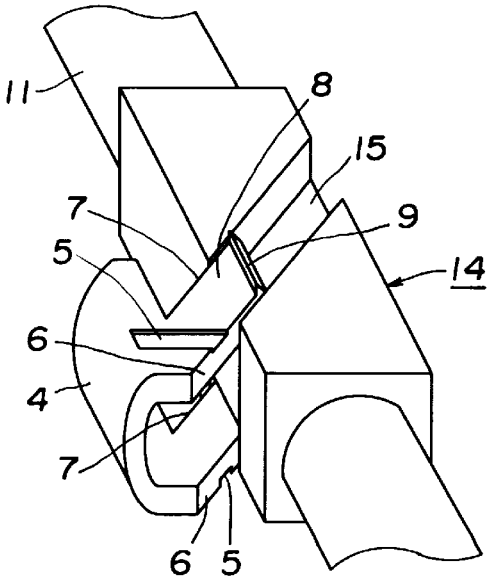
FIG. 2 is a diagrammatic perspective view showing the engagement relationship between a knock button and an engagement portion.
Figure 5:
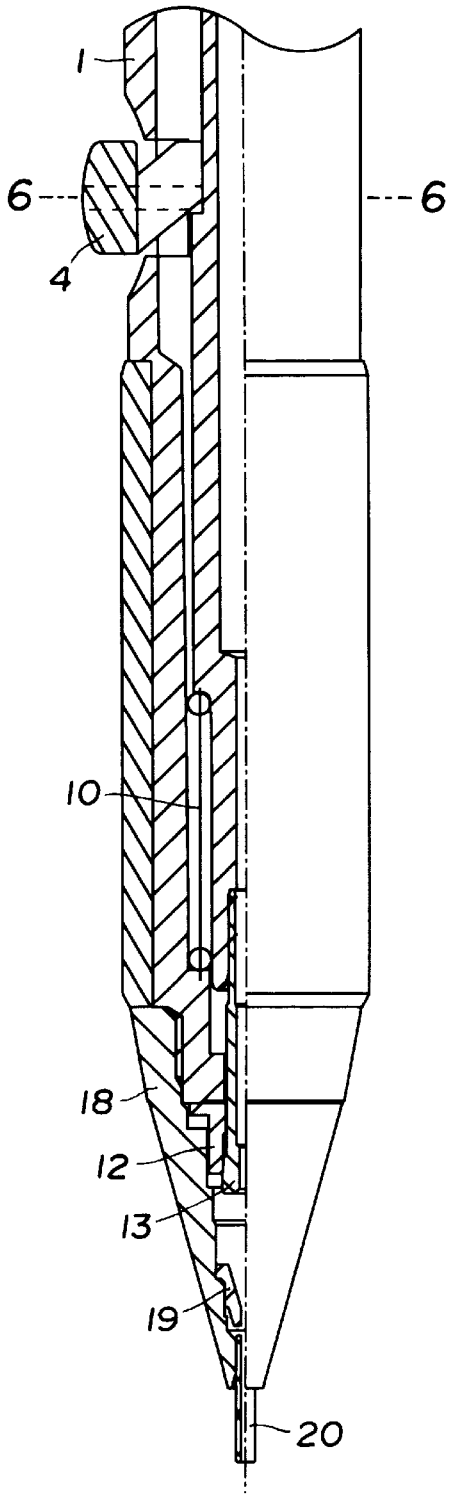
FIG. 5 is a diagrammatic half-sectional view showing the pressed state of the knock button.
Figure 4:
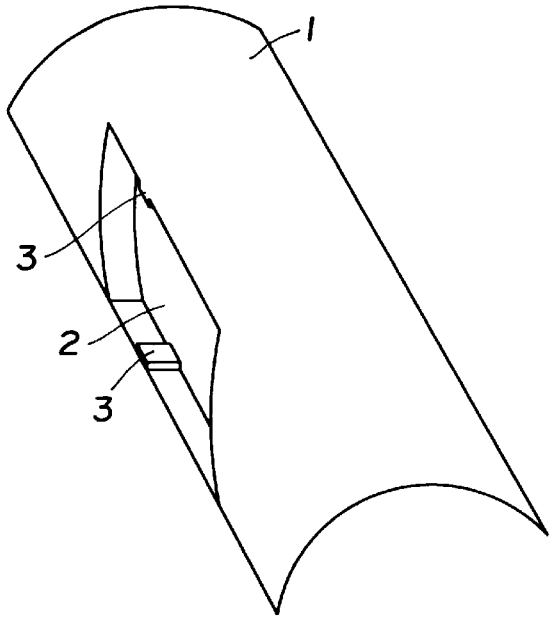
FIG. 4 is a diagrammatic perspective view showing part of the barrel shown in FIG. 1.
Figure 6:
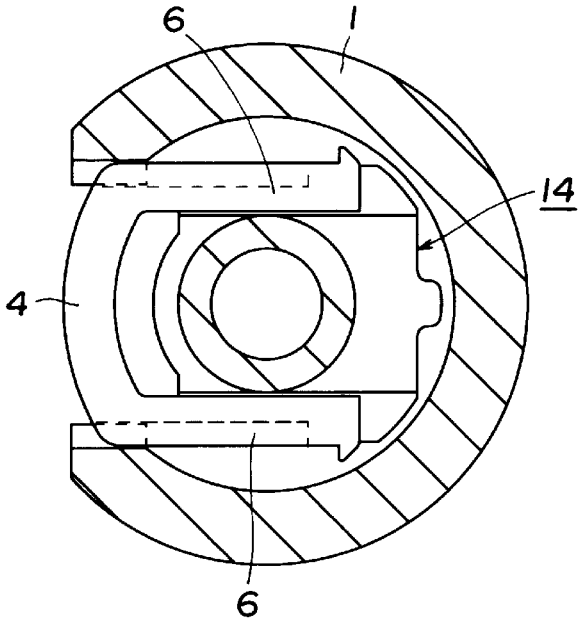
FIG. 6 is a cross-sectional view taken along line 6—6 of FIG. 5.

FIGS. 1 to 6 are explanatory views showing a first embodiment. A through-hole 2 is formed in the side portion of a barrel 1, and guide projections 3 are formed in the through-hole 2. A knock button 4 having a U-shaped cross section is fitted through the through-hole 2 in such a manner as to be movable in opposite radial directions perpendicular to the barrel 1. Guide grooves 5 which are slideably engaged with the respective guide projections 3 are formed in the opposite external sides of the knock button 4. The knock button 4 also has inclined faces 6 for moving forward a lead feeding mechanism which will be described later. Inclined faces 7 which are parallel to the respective inclined faces 6 are formed on sides opposite to the inclined faces 6. In addition, engagement claws 9 for preventing the knock button 4 from coming off the barrel 1 are respectively formed at the ends of press surfaces 8 of the knock button 4.

A lead tank 11 for storing leads and which is urged rearward by a resilient member 10 such as a coil spring is disposed in a front portion of the barrel 1. This lead tank 11 is capable of storing at least two leads, and the knock button 4 is positioned in an intermediate portion of the lead tank 11. A chuck 13 on which a chuck ring 12 is fitted is fixed in front of the lead tank 11. The chuck 13 serves to release and grip a lead, and the chuck ring 12 serves to open and close the chuck 13. The above-described arrangement constitutes the lead feeding mechanism.

An engagement member 14 is fixed to an intermediate portion of the lead tank 11, and inclined grooves 15 are obliquely formed in the engagement member 14. The knock button 4 is slideably engaged with the inclined grooves 15. Specifically, the inclined faces 6 and 7 of the knock button 4 form engagement portions of the knock button 4, and the inclined grooves 15 of the engagement member 14 serve as engagement receiving portions for the respective engagement portions of the knock button 4. The knock button 4 having a U-shape in cross section can be freely inserted relative to the engagement member 14, and it can be press-fitted. This can prevent the knock button 4 from being shaken or dropped from the barrel 1 in case of non-use.

Guide grooves may be formed in the through-hole 2 of the barrel 1, and guide projections to engage with the respective guide grooves may be formed on the opposite external sides of the knock button 4. Each of the guide grooves and the guide projections may have a rectangular shape such as that shown in cross section, or may also have an arcuate shape or a shape composed of a combination of a rectangular shape and an arcuate shape. In other words, it is possible to adopt any shape that can satisfy their engagement relationship and prevent the knock button 4 from shaking in the longitudinal direction of the barrel 1.

Reference numeral 18 denotes a point member which is screwed on the front end of the barrel 1, and the point member 18 may be formed integrally with the barrel 1. A lead retaining member 19 for preventing a lead from moving rearward is press-fitted in the point member 18, and a lead protecting pipe 20, such as a stainless pipe, for protecting the lead is press-fitted in the tip of the point member 18. The lead retaining member 19 and the lead protecting pipe 20 may be formed integrally with the point member 18.

In operation, if the knock button 4 is pressed radially straightforward, the inclined faces 6 of the knock button 4 press the engagement member 14 in the forward direction while sliding on the inclined grooves 15. By this pressing operation, the lead tank 11 and the chuck 13 move forward (refer to FIGS. 5 and 6) and the lead is projected from the lead protecting pipe 20. In this embodiment, the side wall of the knock button 4 can be bent by a relatively small force and this can permit an easy installment of the knock button 4 to the through-hole 2 of the barrel 1.

Figure 7:
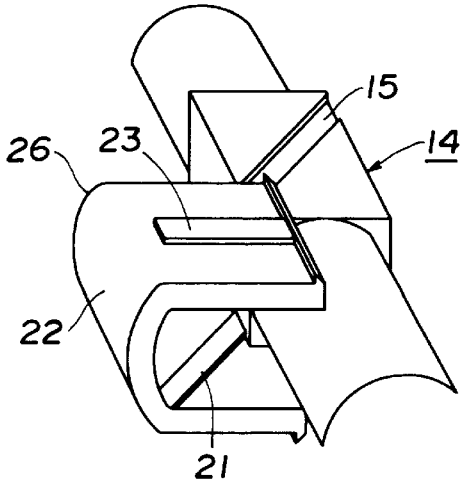
FIG. 7 is a perspective view showing another example of the knock button.

A modification of the knock button 4 will be described with reference to FIG. 7. Engagement portions 21 to engagement with the respective inclined grooves 15 of the engagement member 14 are formed as projecting lines on the opposed internal surfaces of a knock button 22. Of course, the engagement portions 21 are formed in inclined states. In this manner, by forming the engagement portions 21 on the opposed internal surfaces of the knock button 22, it is possible to form long guide projections 23 of the knock button 22 to engage with the guide grooves 5 of the barrel 1 (the through-hole 2), so that shaking of the knock button 22 can be effectively prevented compared to the above-described embodiment.

Figure 8:
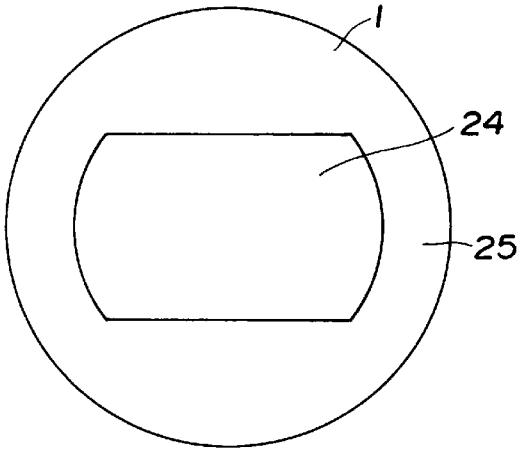
FIG. 8 is a cross-sectional view showing another example of the barrel.

In addition to the arrangement of the above-described embodiment, a reduced-diameter portion 24 may be formed in the inside of the barrel 1 rearwardly of the through-hole 2, and the knock button 22 may be arranged so that a rear end face 26 slides in contact with a face portion 25 formed by the reduced-diameter portion 24, whereby the effect of preventing shaking of the knock button 22 can be improved to a further extent (refer to FIG. 8).

Figure 9:
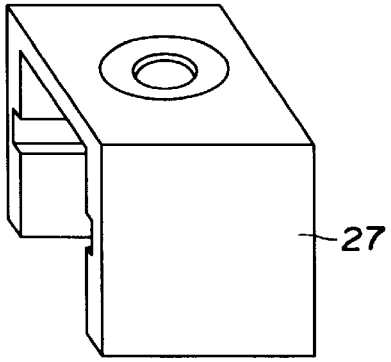
FIG. 9 is a perspective view showing a guide member.

As another example in which guide grooves or projections are formed in a barrel, a guide member 27 which has guide grooves or projections as shown in FIG. 9 may be fitted in the barrel 1 as a separate member. As another method of preventing shaking of the knock button more effectively, in addition to the above-described arrangement, an elastic film, such as natural rubber or silicone rubber, may be formed on the surface of the knock button, or a resilient member, such as a coil spring or magnets which repel each other, may be interposed between the knock button and the barrel.

Figure 10:
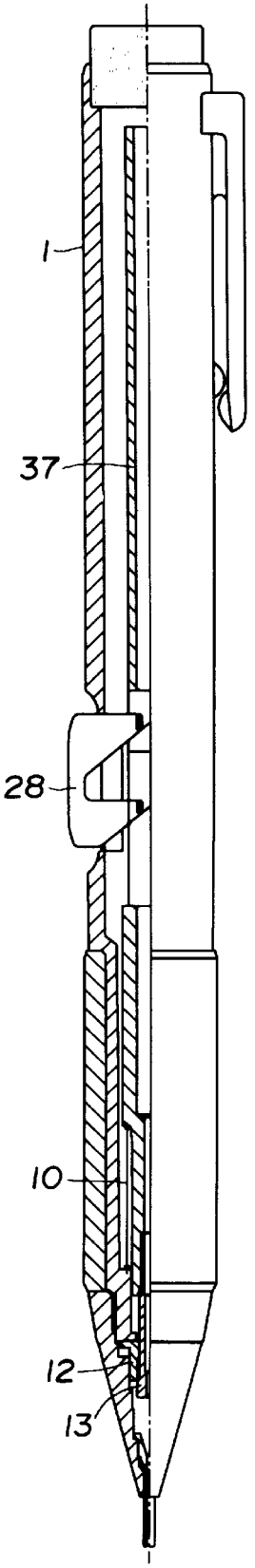
FIG. 10 is a longitudinal half-sectional view showing a second embodiment of the present invention.
Figure 12:
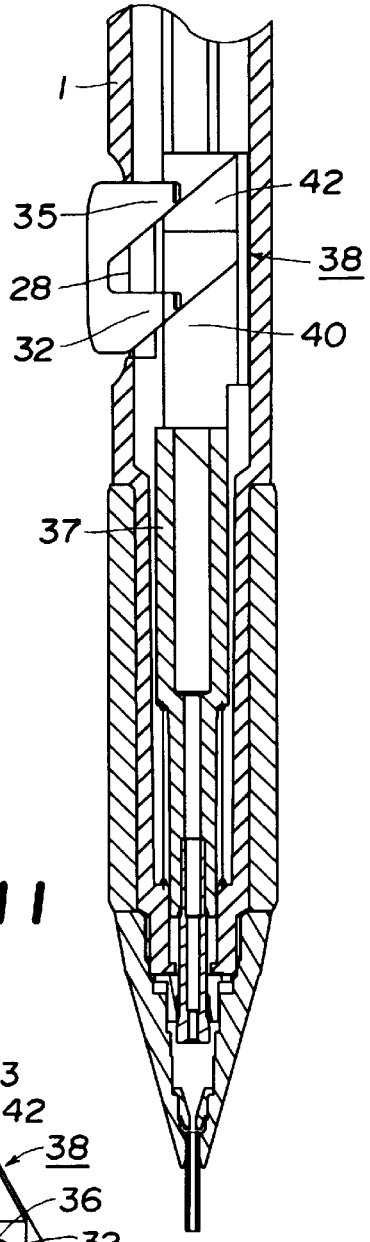
FIG. 12 is a diagrammatic longitudinal half-sectional view showing the pressed state of a knock button.
Figure 11:
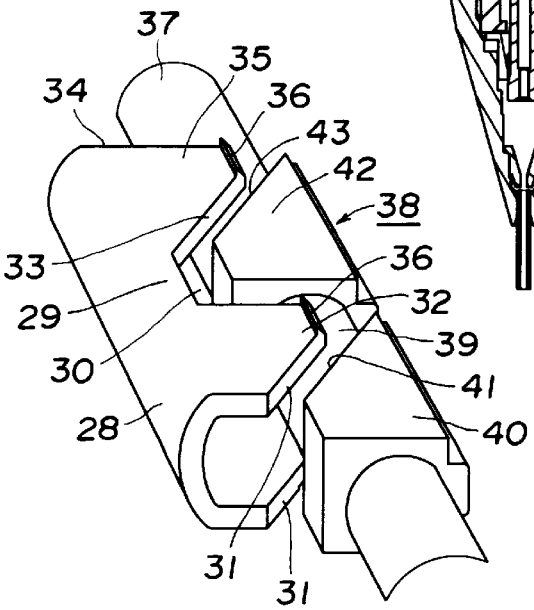
FIG. 11 is a diagrammatic perspective view showing the engagement relationship between a knock button and an engagement portion.

FIGS. 10 to 12 are explanatory views showing a second embodiment. The through-hole 2 is formed in the side portion of the barrel 1, and a knock button 28 having a U-shaped cross section is fitted through the through-hole 2 in such a manner as to be movable in opposite radial directions perpendicular to the barrel 1. Cutouts 30 are respectively formed in the intermediate portions of side portions 29 of the knock button 28, and front inclined faces 31 are formed at the front ends of the respective side portions 29 of the knock button 28. The side portions of the knock button 28 each of which is defined by either one of the cutouts 30 and the corresponding one of the front inclined faces 31 constitute first engagement portions 32, respectively. Rear inclined faces 33 are respectively formed on the rear sides of the cutouts 30. The side portions of the knock button 28, each of which is defined by either one of the rear inclined faces 33 and the corresponding one of rear end faces 34 of the knock button 28, constitute second engagement portions 35, respectively. Reference numerals 36 denote engagement claws which are respectively formed at the bottom ends of the opposite external sides of the knock button 28 and serve to prevent the knock button 28 from coming off the barrel 1.

A lead tank 37 which stores therein a plurality of leads and which is urged rearward by the resilient member 10 such as a coil spring is disposed in a front portion of the barrel 1. The chuck 13 on which the chuck ring 12 is fitted is fixed in front of the lead tank 37.

An engagement member 38 is formed integrally with an intermediate portion of the lead tank 37. The engagement member 38 may be prepared as a separate member. If the engagement member 38 is prepared as a separate member, the engagement member 38 and the lead tank 37 may be fixed to each other, for example, by press fitting, by engagement between projections and recesses, or by bonding.

Cutouts 39 are formed in an intermediate portion of the engagement member 38, and the portions forward from the individual cutouts 39 constitute first engagement receiving portions 40 which respectively engage with first engagement portions 32 of the knock button 28. Intermediate inclined faces 41 are respectively formed at the rear ends of the first engagement receiving portions 40, and engage with the corresponding front inclined faces 31 of the first engagement portions 32. The portions rearward from the individual cutouts 39 constitute second engagement receiving portions 42 which respectively engage with second engagement portions 35 of the knock button 28. Rear inclined faces 43 are respectively formed at the rear ends of the second engagement receiving portions 42, and engage with the corresponding intermediate inclined faces 33 of the second engagement portions 35 of the knock button 28. More specifically, the first engagement portions 32 of the knock button 28 are respectively inserted into the cutouts 39 of the engagement member 38, and the second engagement receiving portions 42 of the engagement member 38 are respectively inserted between the first engagement portions 32 and the second engagement portions 35 of the knock button 28.

The front inclined faces 31 formed on the first engagement portions 32 of the knock button 28 and the intermediate inclined faces 33 formed on the second engagement portions 35 of the knock button 28 may be curved to reduce sliding resistance, so that the knock button 28 can be pressed more smoothly.

Similarly to the modification of the first embodiment, first engagement portions 45 and second engagement portions 46 may be formed on the internal surface of a knock button 44, and inclined groove-shaped engagement receiving portions 48 and 49 which respectively engage with the first engagement portions 45 and the second engagement portions 46 may be formed in an engagement member 47. Since the first engagement portions 45 and the second engagement portions 46 of the knock button 44 can be hidden, it is possible to provide a product having a good external appearance.

In operation, if the knock button 28 is pressed radially straightforward, the front inclined faces 31 and the intermediate inclined faces 33 of the knock button 28 press the engagement member 38 in the forward direction while sliding on intermediate inclined faces 41 and rear inclined faces 43 of the engagement member 38. By this pressing operation, the lead tank 37 and the chuck 13 move forward (refer to FIG. 12) and a lead is fed forward.

An example of the present invention having an added value will be described below with reference to FIGS. 14 and 15. In this example, a rod-shaped feeding device capable of varying the amount of projection of an eraser is provided at a rear portion. The rod-shaped feeding device will be described below. The internal side of the rear end portion of the barrel 1 (a rear portion 1*a*) has a ten-angle shape as shown in FIG. 15 in cross section, but may have a square shape, an elliptical shape or any shape other than a circular shape. A rod-shaped guide member 50, which has a fitting portion 50*a* of hexagonal cross-sectional shape at its front portion, is fitted in the rear portion 1*a*, so that the barrel 1 and the rod-shaped guide member 50 are engaged in such a manner as to be nonrotatable with respect to each other. Guide grooves 50*b* which are opposed to each other are formed in the rear portion of the rod-shaped guide member 50, and the rear ends of the guide grooves 50*b* are joined together and a flange 50*c* is formed. An external tube 51 is fitted on the rod-shaped guide member 50, and a helical groove 51*a* is formed in the internal side surface of the external tube 51. The external tube 51 is clamped between the flange 50*c* which is engaged with one end of the external tube 51 and a fixing member 52, such as an O-ring, which is engaged with the other end of the external tube 51, and is secured to the rod-shaped guide member 50.

Reference numeral 53 denotes a rod-shaped receiving member for clamping an eraser 54*b*. An engagement projection 53*a* is formed on the side surface of the rod-shaped receiving member 53, and is engaged with the helical groove 51*a* via the guide grooves 50*b*.

Figure 14:
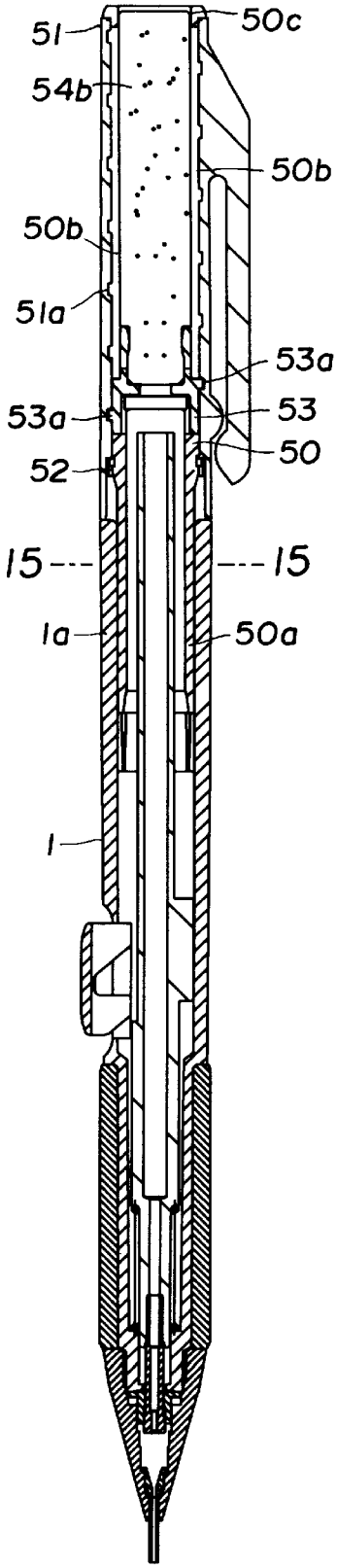
FIG. 14 is a longitudinal sectional view showing another example of use of the present invention.
Figure 15:
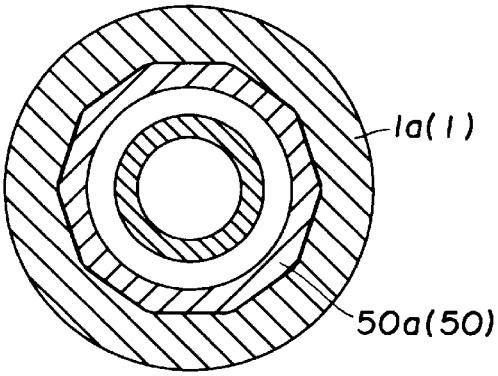
FIG. 15 is a cross-sectional view taken along line 15—15 of FIG. 14.
Figure 13:
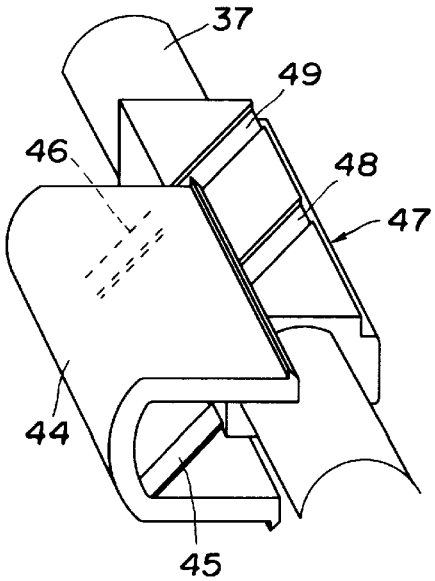
FIG. 13 is a perspective view showing another example of the knock button.

In operation, if the external tube 51 is relatively rotated with respect to the barrel 1 (the rod-shaped guide member 50), the rod-shaped guide member 50 moves upward as viewed in FIG. 14 by means of the helical groove 51*a*. By this movement, the eraser 54*b* is projected. If the eraser 54*b* is to be retracted, the external tube 51 may be reversely rotated.

If a pressure mechanism for feeding a lead, such as that used in the above-described first embodiment, is provided on the lead tank, the rod-shaped feeding device can be added without increasing the overall length of the barrel. If the above-described rod-shaped feeding device is provided in the prior art side-knock type mechanical pencil, the overall length of the barrel increases so that the operability thereof is impaired. This is because a link element which constitutes the pressure mechanism is provided at the position of a lead chuck which constitutes a chuck mechanism. In other words, this is because the link element is positioned at a front of the lead receiving portion which divides the leads one by one. Incidentally, the pressure mechanism, which includes the chuck body and the slide member is positioned at the back of the lead receiving member and in front of the lead tank.

Figure 17:
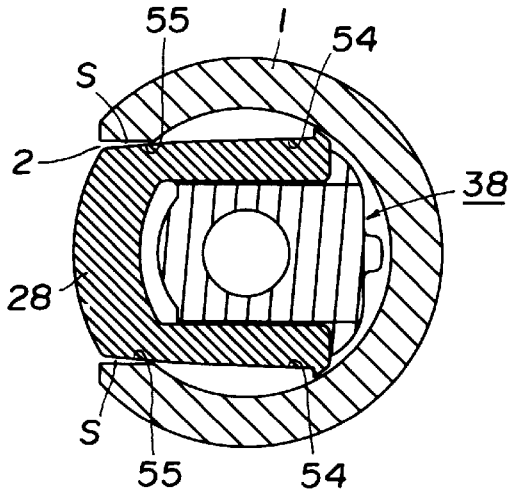
FIG. 17 is a cross-sectional view similar to FIG. 16, showing the pressed state of the knock button.
Figure 16:
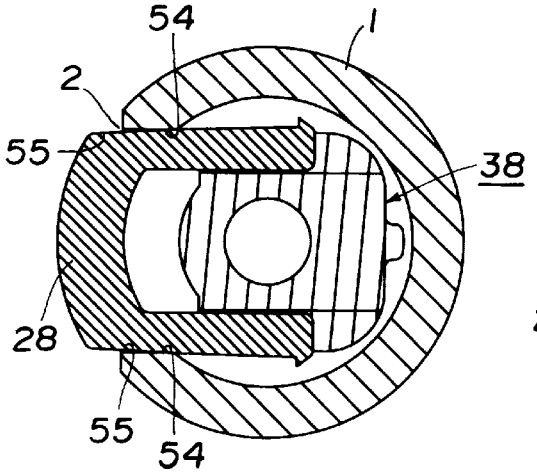
FIG. 16 is a cross-sectional view showing a third embodiment of the present invention.

A third embodiment will be described below with reference to FIGS. 16 and 17. In the third embodiment, to prevent shaking of the knock button, an improvement is introduced into the state of the knock button fitted through the through-hole in each of the first and second embodiments. In the following description, identical reference numerals are used to denote constituent elements identical to those used in the second embodiment. The knock button 28 is formed to increase in width toward its lower portion (toward the engagement claws 36), as viewed in cross section, so that the lower portion of the knock button 28 is press-fitted through the through-hole 2. This large-width portion constitutes a press-fitting portion 54. In addition, the knock button 28 is formed to decrease in width toward its upper portion, so that the width of the upper portion is smaller than that of the through-hole 2. This small-width portion constitutes a non-press-fitting portion 55. If the knock button 28 is pressed, gaps S are produced between the knock button 28 and the wall surface of the through-hole 2 during the process of pressing the knock button 28.

In operation, if the knock button 28 which is press-fitted through the through-hole 2 is pressed radially perpendicularly, as by a finger, the front inclined faces 31 and the intermediate inclined faces 33 of the knock button 28 press the engagement member 38 in the forward direction while sliding on the intermediate inclined faces 41 and the rear inclined faces 43 of the engagement member 38. During the process of this pressing operation, the press-fitting action of the knock button 28 with respect to the through-hole 2 is canceled and the gaps S are formed, and the lead tank 37 and the chuck 13 move forward to feed a lead.

Figure 19:
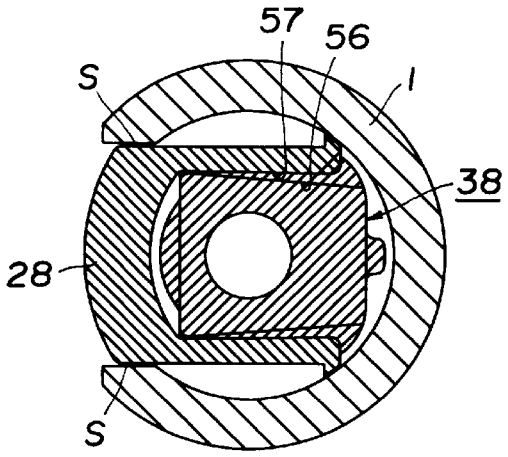
FIG. 19 is a cross-sectional view similar to FIG. 18, showing the pressed state of the knock button.
Figure 18:
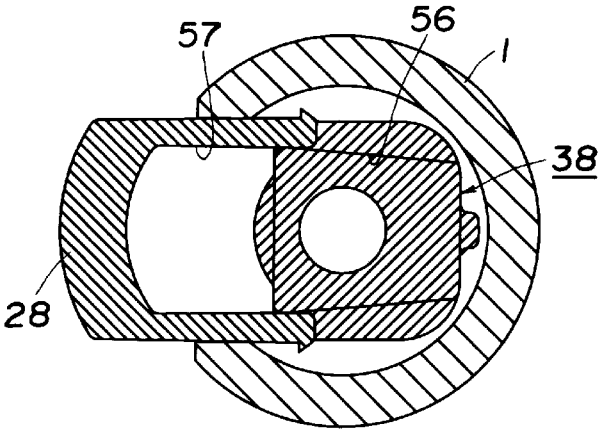
FIG. 18 is a cross-sectional view showing a fourth embodiment of the present invention.
Figure 20:
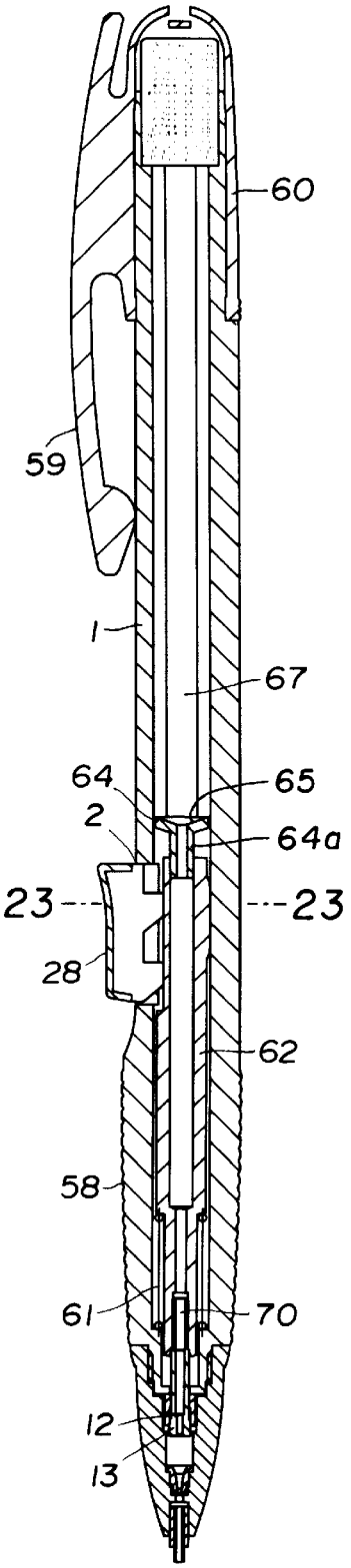
FIG. 20 is a cross-sectional view showing a fifth embodiment of the present invention.
Figure 22:
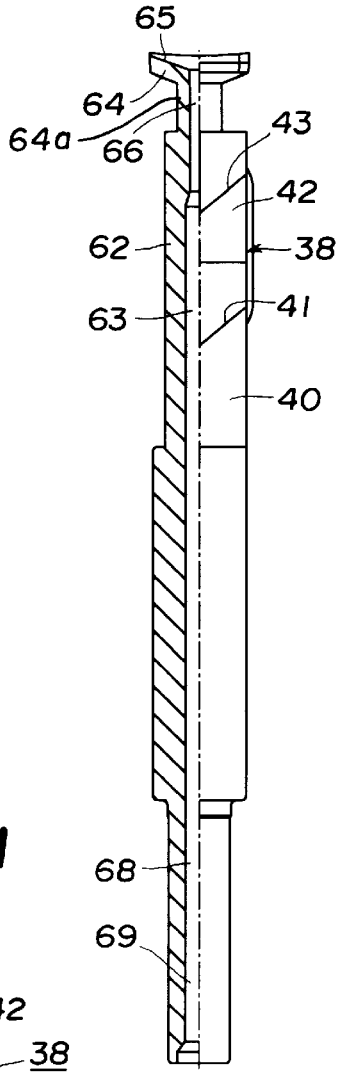
FIG. 22 is a longitudinal half-sectional view showing a slide member.
Figure 21:
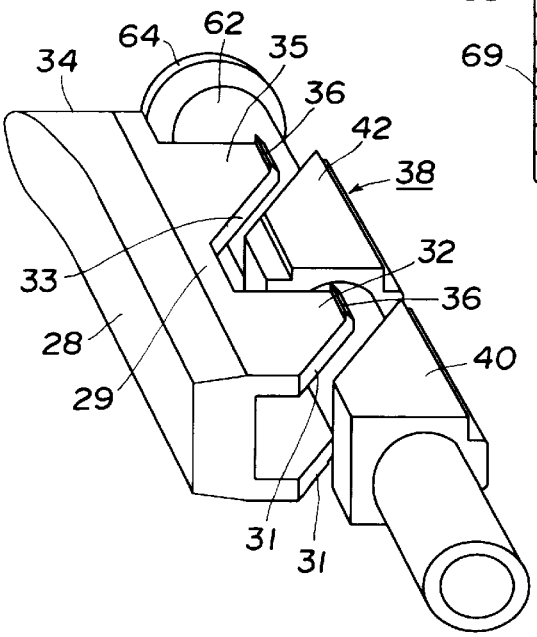
FIG. 21 is a diagrammatic perspective view showing the engagement relationship between a knock button and an engagement portion.
Figure 23:
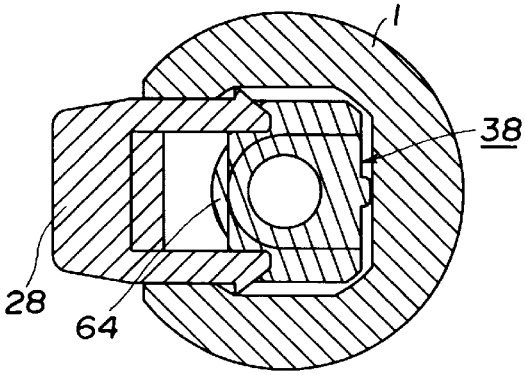
FIG. 23 is a sectional view taken along line 23—23 of FIG. 20.
Figure 24:
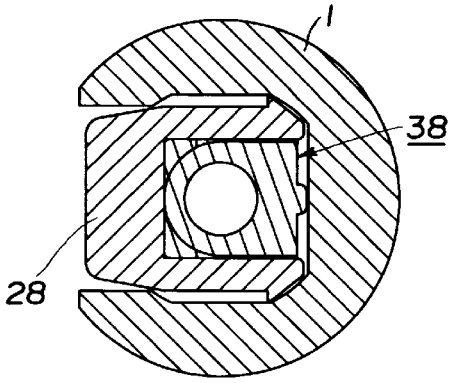
FIG. 24 is a cross-sectional view similar to FIG. 23, showing the pressed state of the knock button.

A modification of the third embodiment will be described below with reference to FIGS. 18 and 19. In this modification, the cutouts 39 of the engagement member 38 are formed to constitute a trapezoidal cross-sectional shape (trapezoidal portion 56) the upper side of which is wider than the lower side, and the U-shaped knock button 28 is formed to constitute a trapezoidal internal shape in cross section (trapezoidal portion 57). As shown in FIG. 18, while the pressing operation is not being performed, the trapezoidal portion 56 of the engagement member 38 pushes open the lower end of the trapezoidal portion 57 of the knock button 28, so that the knock button 28 is press-fitted through the through-hole 2.

In operation, if the knock button 28 which is placed in a press-fitted state is pressed, the intermediate portion of the trapezoidal portion 57 moves past the upper portion of the trapezoidal portion 56 of the engagement member 38 and then the upper portion of the trapezoidal portion 57 reaches the upper portion of the trapezoidal portion 56, so that the lower portion of the trapezoidal portion 57 of the knock button 28 is restored in a direction for reducing the width of the lower portion of the trapezoidal portion 57. This restoration operation is also due to the reduced width of the lower portion of the trapezoidal portion 56 of the engagement member 38. By the restoration of the trapezoidal portion 57 of the knock button 28, the press-fitted state of the through-hole 2 is canceled, and the gaps S are produced between the external sides of the knock button 28 and the wall surface of the through-hole 2. The timing of canceling the press-fitted state is selected so that the press-fitted state is canceled before the intermediate portion of the trapezoidal portion 57 of the knock button 28 reaches the upper side of the trapezoidal portion 56 of the engagement member 38.

A fourth embodiment will be described below with reference to FIGS. 20 to 24. A gripping portion 58, which is knurled or formed by applying and solidifying a paint of comparatively high softness or a liquid rubber material, is formed on the front gripping portion of the barrel 1 (to be gripped during writing). Otherwise, a tubular rubber grip may be fitted as a separate member. By forming the gripping portion 58 or by fitting the rubber grip, it is possible to ease or lessen fatigue due to writing, in discomfort the fingers of the user or the like. The through-hole 2 is formed in the side portion of the barrel 1 rearwardly of the gripping portion 58, and the knock button 28 having a U-shaped cross section is fitted through the through-hole 2 in such a manner as to be movable in opposite radial directions perpendicular to the barrel 1. The knock button 28 has a construction similar to the knock button used in the second embodiment, and the description thereof is omitted.

A cap 60 formed integrally with a clip 59 is removably fitted on the rear portion of the barrel 1. Only the clip 59 may be formed integrally with the barrel 1.

A slide member 62 which is urged rearward by a resilient member 61, such as a coil spring, is disposed in the front portion of the barrel 1. The chuck 13 on which the chuck ring 12 is fitted is fixed to the front of the slide member 62.

The engagement member 38 is formed integrally with the intermediate portion of the slide member 62, but may be prepared as a separate member. If the engagement member 38 is prepared as a separate member, the slide member 62 and the engagement member 38 may be fixed to each other, for example, by press fitting, by engagement between projections and recesses, or by bonding. The engagement member 38 has a construction approximately similar to that of the engagement member used in the second embodiment, and the description thereof is omitted.

A lead introducing hole 63 for inserting therethrough approximately two or three leads is formed in the rear end of the slide member 62, and a lead receiving member 64 having an external diameter approximately equal to the internal diameter of the barrel 1 is press-fitted into the rear end portion of the lead introducing hole 63. The lead receiving member 64 has a head portion 65 shaped like a cone so that a lead can easily fall, and a tubular body portion 64*a* having a lead inserting hole 66 for introducing the lead into the lead introducing hole 63. The tubular body portion 64*a* is formed in the lower end of the cone-shaped head portion 65. The internal portion of the barrel 1 rearward from the lead receiving member 64 constitutes a lead tank portion 67, and leads fall one by one into the lead introducing hole 63 through the lead inserting hole 66. A hole 68 and a chuck press-fitting hole 69 each having a diameter approximately equal to the diameter (external diameter) of a lead is formed in the front portion of the slide member 62 adjacently to the lead introducing hole 63. The diameter of the hole 68 may be made equal to the internal diameter of the lead introducing hole 63 or the internal diameter of the chuck press fitting hole 69, and the diameter of a hole 70 formed in the rear end of the chuck 13 may be made equal to the diameter of the lead.

The feature of the above-described fifth embodiment will be described below. Since the lead introducing hole is formed to have a diameter greater than the diameter of the lead, a core pin is not easily bent in the case of injection molding or the like. In addition, since even a product having a non-circular cross-sectional shape is not easily bent during molding, a straight lead introducing hole can be formed.

Since the knock button 28 is disposed rearward of the gripping portion 58 and forward of the clip 59, it is possible to prevent the knock button 28 from being pressed by accident during writing.

In operation, if a plurality of leads are inserted into the lead tank portion 67, one lead is separated from the leads by the lead inserting hole 66 of the cone-shaped portion 65 and introduced into the chuck 13 through the lead introducing hole 63 and the hole 68. Even if the leads are curved to some extent or the slide member 62 is curved to some extent, as by molding, since the lead introducing hole 63 is formed to have a diameter greater than the external diameter of each lead, the lead is smoothly introduced into the chuck 13. At this time, if the knock button 28 is pressed radially straightforward, the front inclined faces 31 and the intermediate inclined faces 33 of the knock button 28 press the engagement member 38 in the forward direction while sliding on the intermediate inclined faces 41 and the rear inclined faces 43 of the engagement member 38. By this pressing operation, the slide member 62 and the chuck 13 move forward and the lead is fed forward.

Although not shown, since the length of the chuck from its lead gripping portion to its lead receiving portion is selected to be greater than the length of the lead used, the remaining leads excluding one lead which immediately follows the forward fed lead do not come into contact with the rear end thereof, so that the forward fed lead is smoothly inserted into (or smoothly falls into) the lead gripping portion of the chuck. Since one lead immediately follows the rear end of the forward fed lead, as the forward fed lead is gradually worn out (becomes gradually shorter), the immediately following lead is smoothly moved and fed forward.

Figure 26:
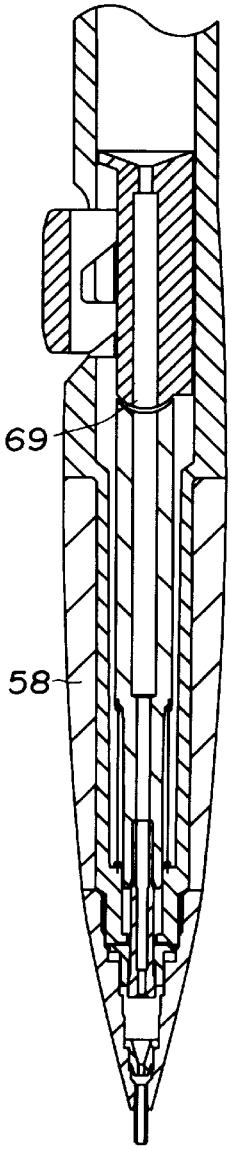
FIG. 26 is a longitudinal sectional view showing another modification of the slide member.
Figure 25:
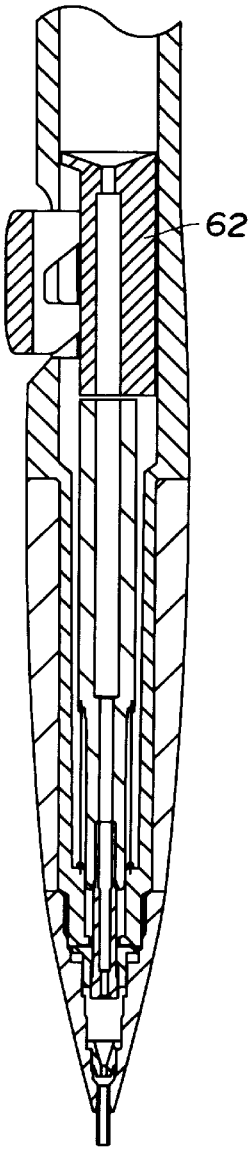
FIG. 25 is a longitudinal sectional view showing a modification of the slide member.

In the previous embodiment, the slide member is composed of one member to reduce the production cost, and it can be composed of a plurality of divided parts so as to prevent bending or curve. This is shown is FIG. 25 in which the slide member 62 is composed of two members. By this structure, the materials for the member to which the chuck is press-fitted and for the member which forms the engagement portion can be selected. In case that the slide member is composed of two members, a mutual surface-contact can be applied but a preferred feature as shown in FIG. 26 can be applied in which a concave-convex engagement portion 69 is formed. Further, if the slide member is composed of two elements, a pressing distance of the chuck relative to the slide member can be adjusted so that a reliable gripping force of the chuck can be maintained. Further, a pressing distance of the knock button is increased and, therefore, a reliable pressing operation can be achieved.

Figure 27:
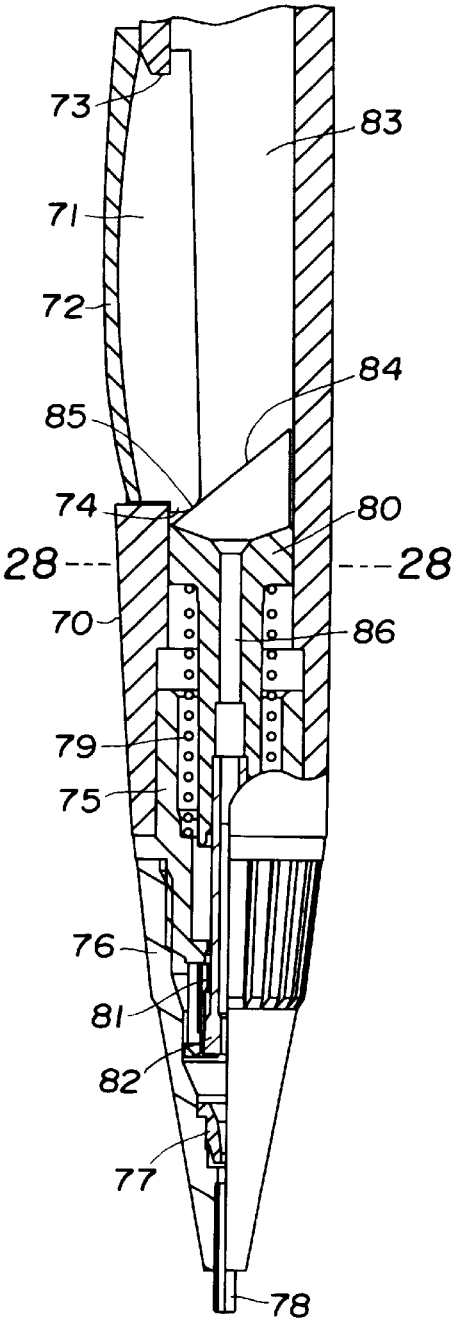
FIG. 27 is a diagrammatic longitudinal sectional view showing a sixth embodiment of the present invention.
Figure 28:
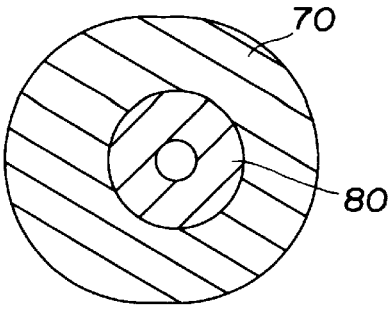
FIG. 28 is a cross-sectional view taken along line 28—28 of FIG. 27.

A sixth embodiment will be described below with reference to FIGS. 27 and 28. A through-hole 71 is longitudinally formed in the side portion of a barrel 70, and a knock button 72 having a U-shaped cross section is fitted through the through-hole 71 in such a manner as to be rotatable about the rear end of the knock button 72 in the radial direction of the barrel 1. In the shown embodiment, the knock button 72 is secured to the barrel 1 in such a way that a recess 73 which is formed in the rear end of the knock button 72 is fitted onto one end portion (rear end portion) of the through-hole 71 and also a projection 74 which is formed at the front end of the knock button 72 is engaged with the other end portion (front end portion) of the through-hole 71. (The top and bottom of FIG. 27 correspond to "rear" and "front", respectively.) However, the method of securing the knock button 72 to the barrel 1 is not limited to this example. For example, the knock button 72 may be arranged to move in parallel with the radial direction of the barrel 70. A point member 76 is screwed onto the front of the barrel 70 via a joint member 75. A lead retaining member 77 for preventing a lead from moving rearward is press-fitted in the point member 76, and a lead protecting pipe 78, such as a stainless pipe, for protecting the lead is press-fitted in the tip of the point member 76.

A slide member 80 which is urged rearward by a resilient member 79, such as a coil spring, is disposed in the joint member 75. A chuck 82 on which a chuck ring 81 is fitted is fixed to the front of the slide member 80. The chuck 82 serves to release and grip a lead, and the chuck ring 81 serves to open and close the chuck 82. A lead tank portion 83 in which to store a plurality of leads is provided at the rear of the slide member 80, and the lead tank portion 83 also constitutes the inside of the barrel 70, i.e., the barrel 70 itself constitutes the lead tank portion 83.

The slide member 80 will be described below in detail. Inclined faces 84 are formed at the rear end of the slide member 80, and abut against a bottom face 85 of the front end of the knock button 72. The rear portion of the slide member 80 has a circular cross-sectional shape, as shown in FIG. 28, and is formed to have an external diameter approximately equal to the internal diameter of the barrel 70. The external diameter is selected to form a gap which allows the slide member 80 to move in the barrel 70 and does not allow passage of a lead to be used. Specifically, if a so-called 0.5 mm lead is used (the allowable diameter range of a lead having a nominal diameter of 0.5 mm specified in JIS (Japanese Industrial Standards) S6013 is 0.55 mm to 0.58 mm), the gap between the barrel 1 and a slide button 9 may be set to approximately 0.1–0.3 mm. If a so-called 0.2 mm lead is used, such gap may be set to approximately 0.05–0.1 mm. The amount of the gap can be arbitrarily selected according to the diameter of a lead to be used.

A lead inserting hole 86 for introducing a lead into the chuck 82 is formed in the lengthwise center of the slide member 80.

By adopting the above-described basic arrangement, the present invention makes it possible to form the barrel 70 itself as the lead tank portion 83, and also to correctly introduce a lead from the barrel 70 (the lead tank portion 83) into the chuck 13.

Figure 29:
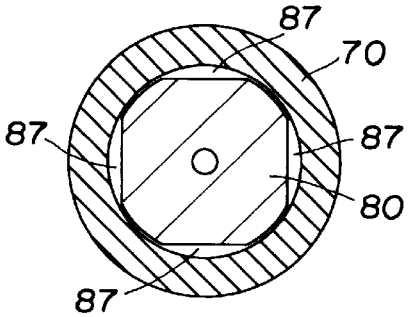
FIG. 29 is a cross-sectional view showing a modification of the sixth embodiment of FIG. 27.
Figure 30:
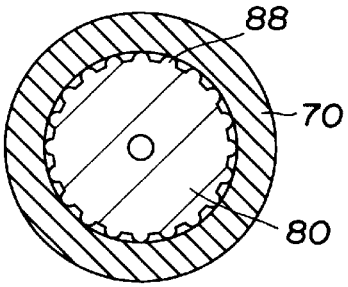
FIG. 30 is a cross-sectional view showing another modification of the sixth embodiment of FIG. 27.
Figure 31:
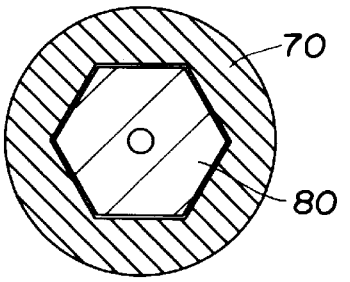
FIG. 31 is a cross-sectional view showing another modification of the sixth embodiment of FIG. 27.

Several modifications will be described below in detail. In a first modification, the rear portion of the slide member 80 has a different cross-sectional shape. In the example shown in FIG. 29, the slide member 80 is formed into an approximately square shape, and its four corners are removed so that the slide member 80 slides on the internal wall surface of the barrel 70. The relationship between the shape of the slide member 80 and that of the internal wall surface of the barrel 70 may be inverted. Of course, the size of each gap 87 produced between the slide member 80 and the barrel 70 is made smaller than the diameter of a lead to be used. In the example shown in FIG. 30, small projections (longitudinal ribs) 88 may be formed on the surface of the slide member 80 so that the slide member 80 slides on the internal wall surface of the barrel 70. However, similarly to the aforesaid example, the relationship between the shape of the slide member 80 and that of the internal wall surface of the barrel 70 may be inverted, i.e., the cross-sectional shape of the slide member 80 may be formed into a circular shape, and the small projections may be formed on the internal wall surface of the barrel. In this example as well, the height of each of the projections 88 is made smaller than the diameter of a lead to be used. Any of the examples is intended to reduce the sliding resistance of the slide member to the barrel. In the example shown in FIG. 31, the internal shape of the barrel 70 is formed into a hexagonal shape, and the external shape of the slide member 80 is also formed into a hexagonal shape. In addition to the above-described shapes, various other shapes can be adopted.

Figure 32:
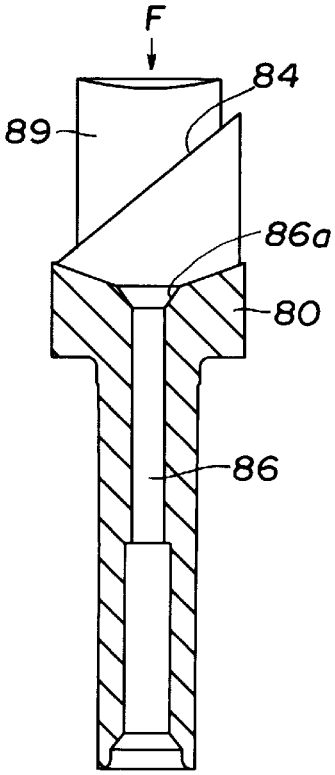
FIG. 32 is a cross-sectional view showing another modification of the slide member.
Figure 34:
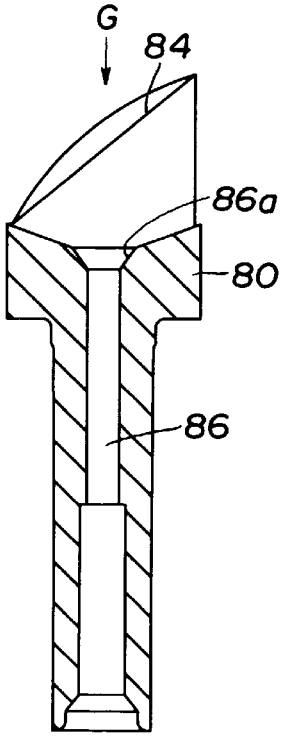
FIG. 34 is a longitudinal sectional view showing still another modification of the slide member.
Figure 36:
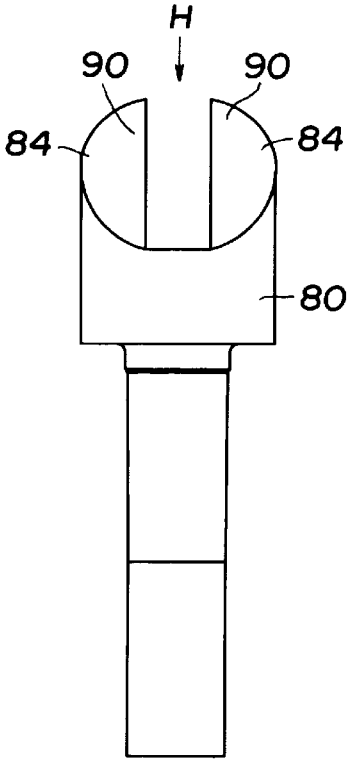
FIG. 36 is a longitudinal sectional view showing still another modification of the slide member.
Figure 43:
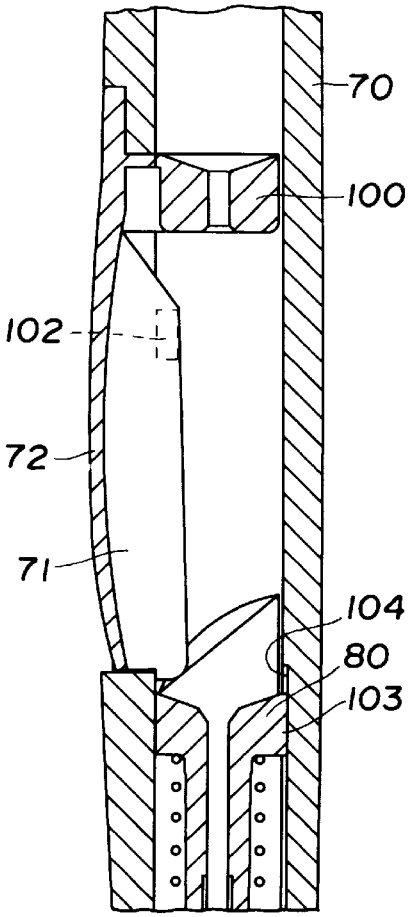
FIG. 43 is a diagrammatic longitudinal sectional view showing another modification of the knock button.
Figure 45:
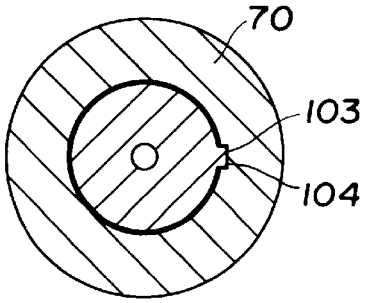
FIG. 45 is a cross-sectional view showing the engagement relationship between the slide member and the barrel.

A second modification is intended to securely prevent a slide member having a circular cross-sectional shape or the slide member 80 of the first modification from rotating with respect to the barrel 70. Engagement portions 89 are formed outside the respective inclined faces 84 of the slide member 80, and are brought into surface contact with the corresponding side faces of the knock button 72 (refer to FIGS. 32 and 33). Thus, rotation of the slide member 80 is prevented by the knock button 72. As shown in FIGS. 43 and 45, a projection may be formed on a bottom portion of the slide member and a slide groove with which to engage the projection may be formed in the internal wall surface of the barrel, to prevent rotation of the slide member.

Figure 33:
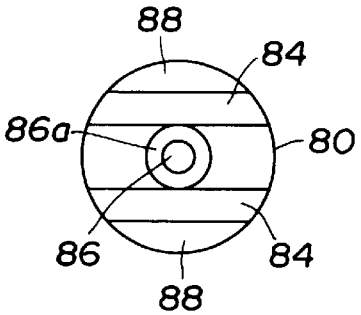
FIG. 33 is a view taken in the direction of an arrow F of FIG. 32.
Figure 35:
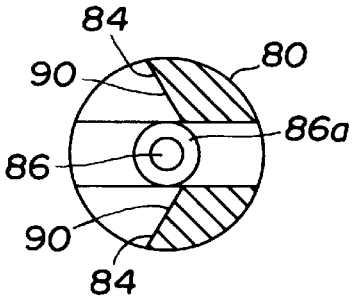
FIG. 35 is a view taken in the direction of an arrow G of FIG. 34.
Figure 37:
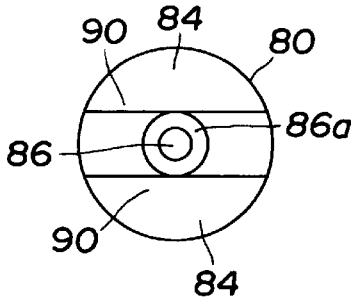
FIG. 37 is a view taken in the direction of an arrow H of FIG. 34.

A third modification makes it far easier to insert a lead into the lead inserting hole of the slide member. As shown in FIG. 33, the upper end portion of the lead inserting hole 86 of the slide member 80 may be formed into a conical shape (conical portion 90). As shown in FIGS. 34 to 37, inclined surface portions 90 each of which is gradually reduced in diameter from the upper end of the corresponding inclined face 84 toward the internal center thereof (the lead inserting hole 86) may be formed.

Figure 38:
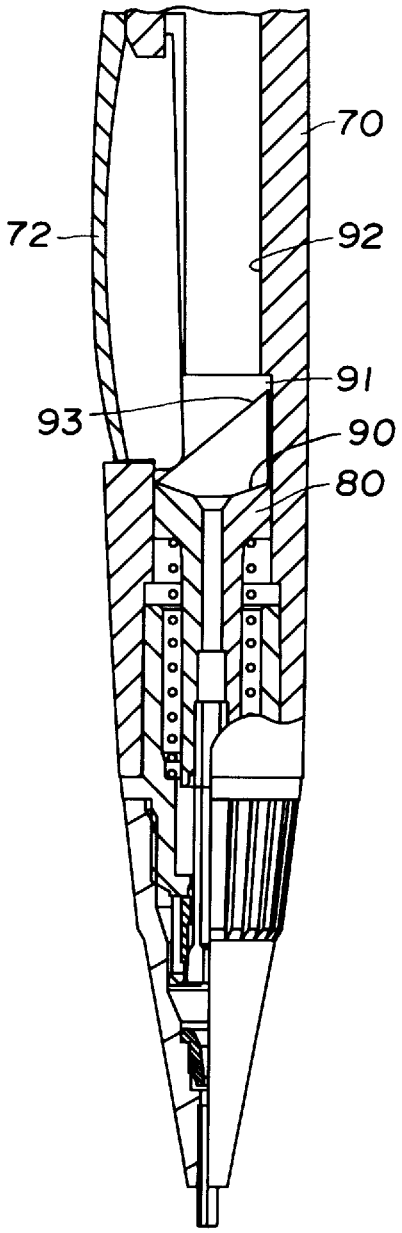
FIG. 38 is a diagrammatic longitudinal sectional view showing a modification of the barrel.

FIG. 38 shows a fourth modification which makes it far easier to insert a lead into the slide member. A step 91 is formed on the internal wall surface of the barrel 70 rearwardly of the slide member 80, and a small-diameter portion 92 is formed to extend rearward from the step 91. Thus, a lead is prevented from being caught by a rear end periphery 93 of the slide member 80.

In each of the above-described modifications, the overall length of the barrel can be made short. In addition, since leads abut against the inclined faces of the slide member, the lead oil contained in the leads adheres to the inclined faces, so that the knock button can smoothly press (slide on) the inclined faces (the slide member). Further, in the fourth modification in which the lead receiving portion is formed directly on the slide member, the entire length of the barrel can be made shorter.

Figure 39:
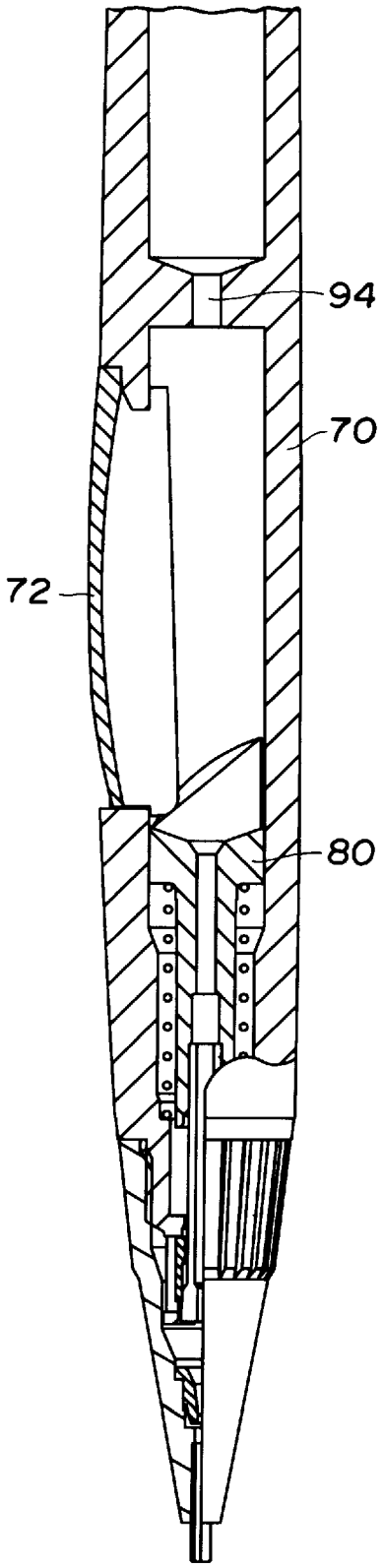
FIG. 39 is a diagrammatic longitudinal sectional view showing another modification of the barrel.
Figure 40:
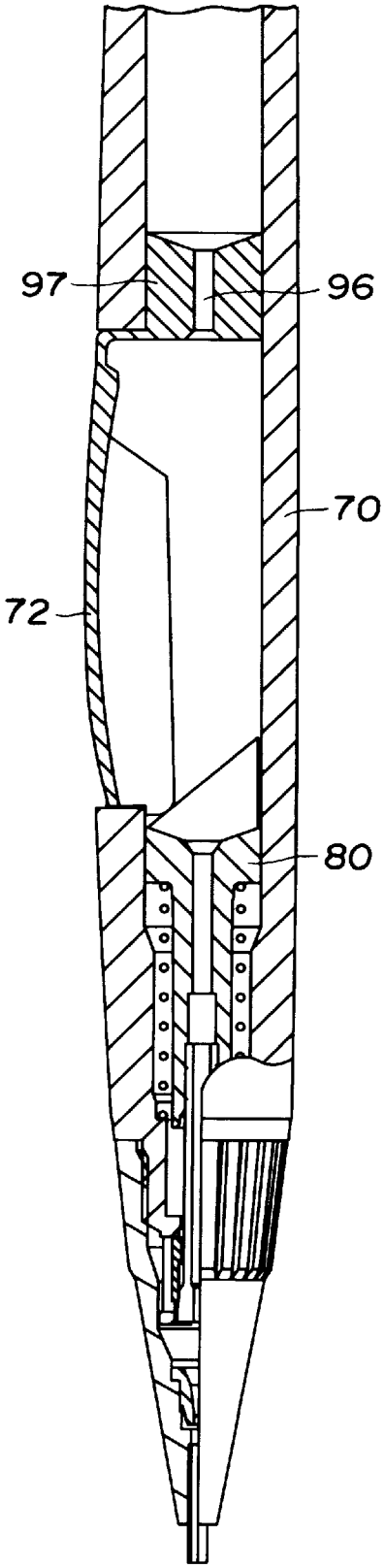
FIG. 40 is a diagrammatic longitudinal sectional view showing a modification of the knock button.

As shown in FIG. 39, a restricting portion 95 having a hole 94 through which one lead can be inserted may be formed in the inside of the barrel 70 rearwardly of the knock button 72. As shown in FIG. 40, a restricting portion 97 having a hole 96 through which one lead can be inserted may be formed rearward of the knock button 72. Since no lead stays in the rear portion of the slide member 80, each lead can be smoothly introduced into the lead inserting hole 86. Specifically, the restricting portion 95 or the restricting portion 97 serves as a substantial lead receiving portion, and the portion rearward from the portion 95 or 97 serves as a lead tank portion.

Figure 41:
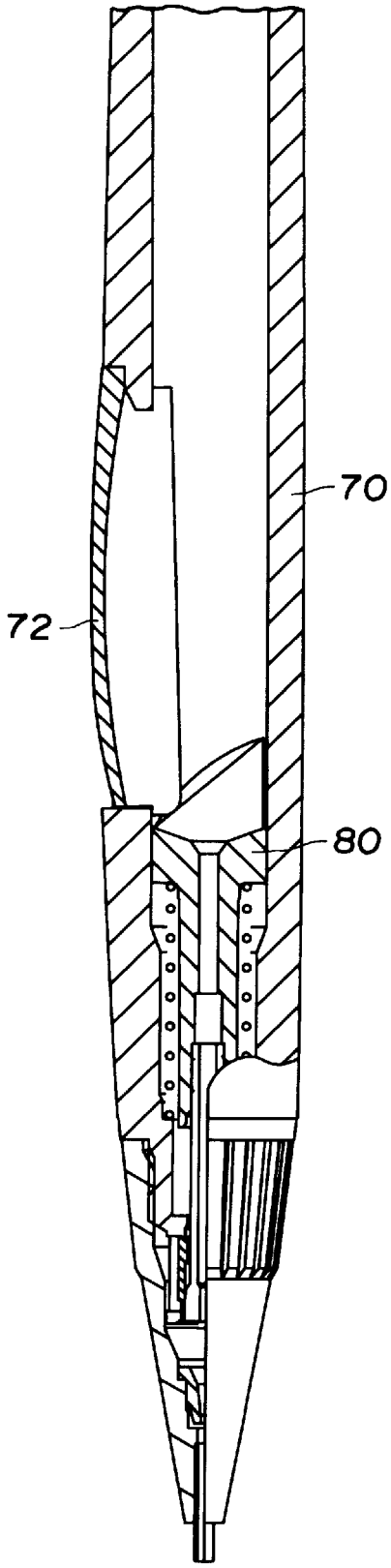
FIG. 41 is a diagrammatic longitudinal sectional view showing another modification of the sixth embodiment show in FIG. 27.

Although each of the above-described modifications to which the present invention is applied has a joint member, as shown in FIG. 41, a point member may be directly secured to the front end of the barrel, and a lead feeding mechanism may be secured in the front portion of the barrel. Accordingly, a further reduction in price can be realized.

Figure 42:
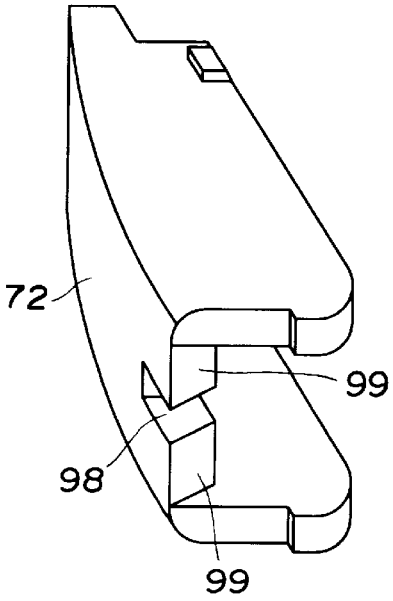
FIG. 42 is a diagrammatic longitudinal sectional view showing another modification of the knock button.

In addition, the knock button may have a cutout 98 and inclined faces 99 or a rounded portion so that when the knock button is pressed, a lead is prevented from being broken, as by a corner of the front end of the knock button (refer to FIG. 42). Of course, the length of the cutout 98 is selected so that no lead pass through the cutout 98.

Various modifications of the restricting portion formed near the rear end of the knock button will be described below.

Figure 44:
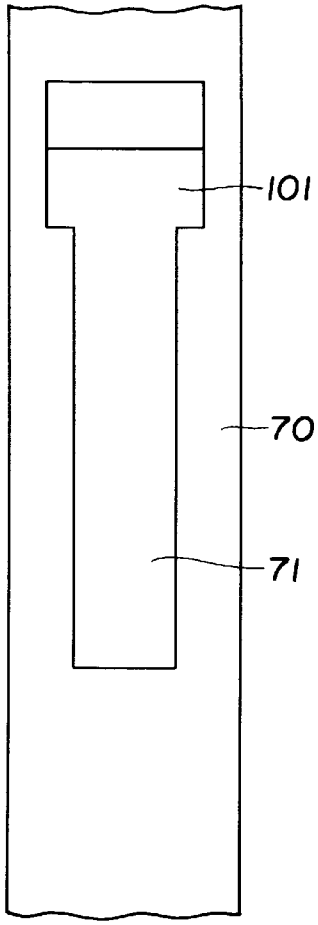
FIG. 44 is a diagrammatic view showing the external appearance of another modification of the barrel.

FIG. 43 shows a first modification in which a restricting portion 100 is positioned opposite to the position of the restricting portion in the example shown in FIG. 40, i.e., the restricting portion 100 is formed to be positioned in the through-hole 71 so that the restricting portion 100 does not enter the barrel 70. As shown in FIG. 44, a large-diameter hole 101 into which the restricting portion 100 can be fitted is formed rearward of the through-hole 71 of the barrel 70. The knock button 72 can be attached to the barrel 70 by being inserted through the through-hole 71 and the large-diameter hole 101, so that the mechanical pencil can be assembled by a simple process.

Engagement projections 102 are formed at the rear end portion of the knock button 72, and the engagement projections 102 engage with the internal wall surface of the barrel 70 to prevent the knock button 72 from coming off the barrel 70. A projection 103 is formed on the bottom portion of the slide member 80, and the projection 103 engages with a groove 104 formed in the internal wall surface of the barrel 1 and prevents the slide member 80 from rotating with respect to the barrel 70 (refer to FIG. 45).

Figure 46:
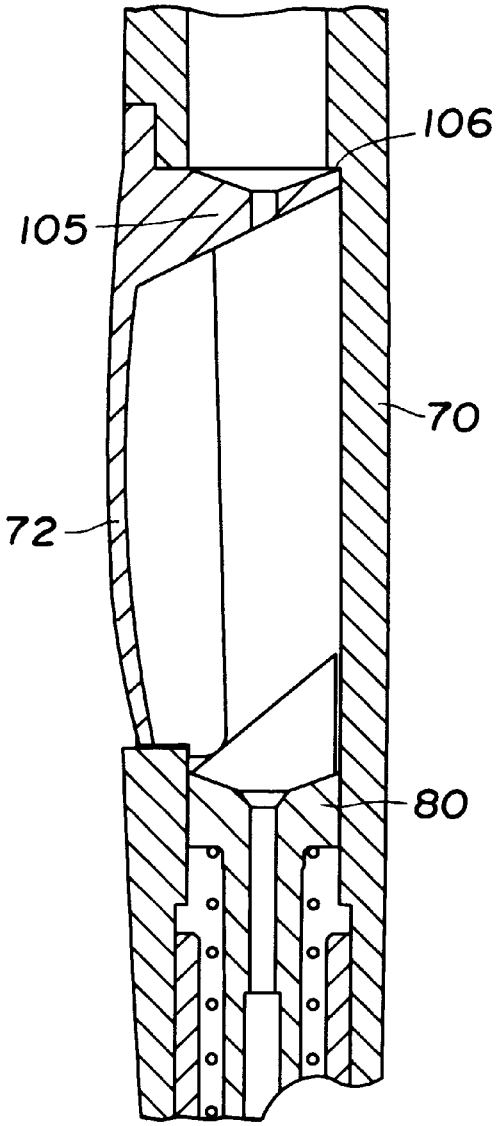
FIG. 46 is a diagrammatic longitudinal sectional view showing still another modification of the knock button.
Figure 47:
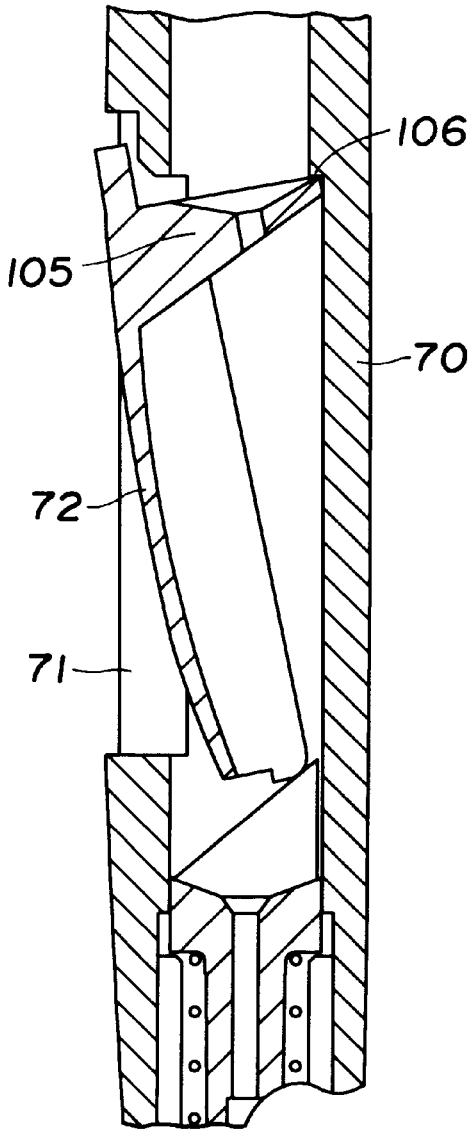
FIG. 47 is a cross-sectional view similar to FIG. 46, showing the pressed state of the knock button.

FIG. 46 shows an example in which the knock button 72 can be rotated on a different pivotal point in opposite radial directions of the barrel 70. A restricting portion 105 of the knock button 72 has a triangular cross-sectional shape and a step 106 is formed on the internal surface of the barrel 70, and a portion of the rear end of the restricting portion 105 is engaged with the step 106. The knock button 72 is rotated by using this point of engagement as a pivotal point (refer to FIG. 47).

In each of the aforesaid examples having the restricting portions, the external diameter of the slide member 80 is made approximately equal to the internal diameter of the barrel 70 so that a lead is prevented from entering the resilient member 10 or the gap between the slide member 80 and the barrel 70. However, the present invention is not particularly limited to such example.

Since the rear portion of the barrel 70 itself constitutes a lead tank, it is not necessary that the lead tank be prepared as a separate member as proposed in the prior art. Accordingly, a further reduction in production cost can be realized. In addition, since the lead receiving portion is formed rearward of the knock button, a clear discrimination can be made between the front and the rear of the knock button, so that the knock button is prevented from being erroneously inserted into the barrel with the rear in front when the knock button is to be fitted into the barrel (during assembly). Since a clear discrimination can be made between the front and the rear of the knock button, a decision as to the direction of the knock button can be made quickly, so that the knock button and the barrel can be assembled easily and quickly and productivity is improved.

Figure 48:
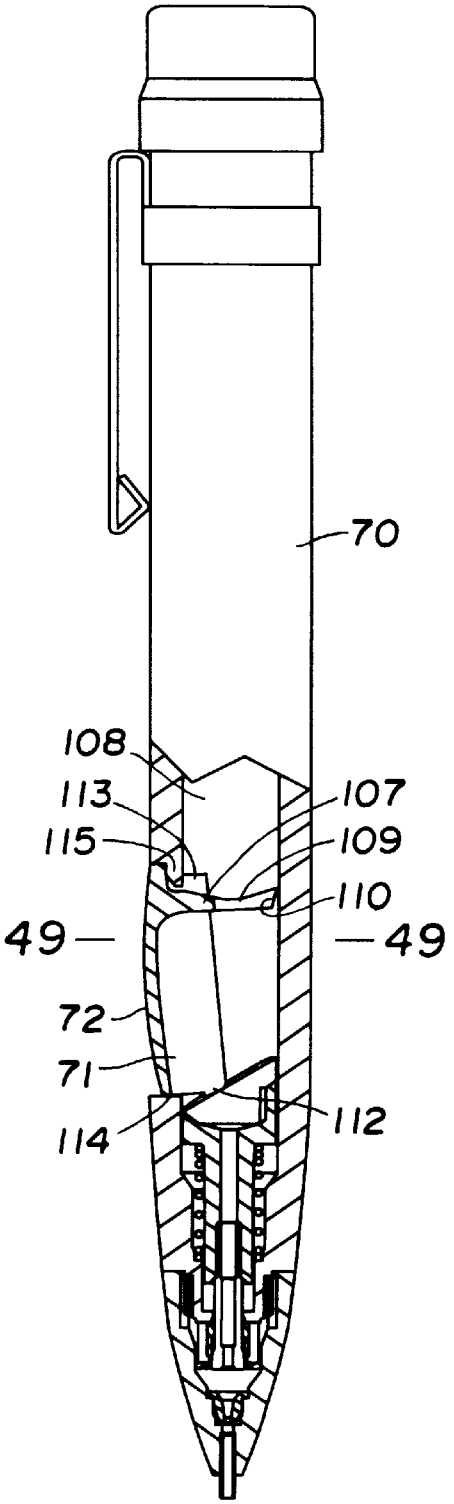
FIG. 48 is a diagrammatic longitudinal sectional view showing still another modification of the knock button.
Figure 49:
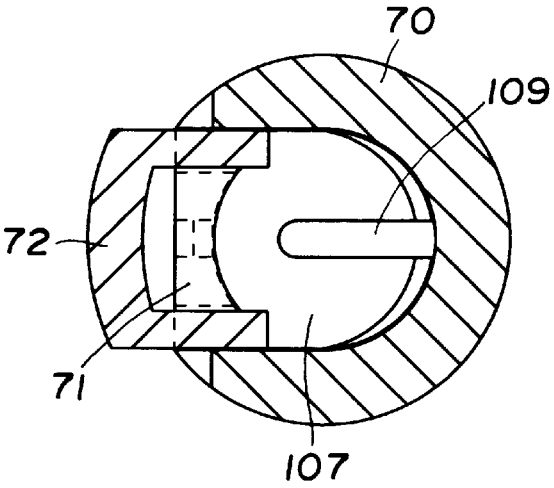
FIG. 49 is a cross-sectional view taken along line 49—49 of FIG. 48.

FIGS. 48 and 49 show a second modification in which a lead inserting hole 108 of a restricting portion 107 is formed into a slit-like shape. The through-hole 71 is formed in the side portion of the barrel 70 in the longitudinal direction thereof, and the knock button 72 having a U-shaped cross section is fitted through the through-hole 71 in such a manner as to be rotatable about the rear end portion of the knock button 72 in opposite radial directions of the barrel 1. The restricting portion (lead receiving portion) 107, which has an external diameter approximately equal to the internal diameter of the barrel 70 and which is slightly inclined forward from the axis, is formed integrally with the rear end portion of the knock button 72. If the external diameter of the restricting portion is made approximately equal to the internal diameter of the barrel 70, the restricting portion 107 may be fitted in the barrel 70 or a gap which does not allow passage of a lead may be formed between the restricting portion 107 and the barrel 70. A wall is formed in the middle portion of the barrel 70 by the restricting portion 107, so that the portion rearward from the restricting portion 107 (the upper portion of FIG. 48) constitutes the lead inserting hole 108. A slit-shaped lead inserting hole 109 is formed in the center of the restricting portion 107, but an inclined surface may also be formed rearward of the lead inserting hole 109 so that a lead easily falls toward the lead inserting hole 109. An inclined surface 110 is formed at the lower end of the restricting portion 107 (the end of the restricting portion 107 opposed to the side on which the knock button is formed). The inclined surface 110 serves to prevent the lower end portion of the restricting portion 107 from coming into contact with the internal surface of the barrel 70 when the knock button 72 is pressed.

Projections 112 and 113 are respectively formed at the front and rear ends of the knock button 72, and the respective projections 112 and 113 engage with internal faces 114 and 115 of the front and rear ends of the through-hole 71 so that the knock button 72 is prevented from being ejected from (coming off) the barrel 70.

Figure 50:
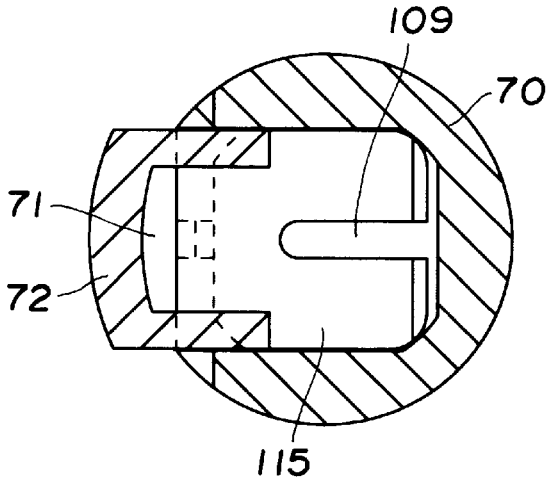
FIG. 50 is a cross-sectional view similar to FIG. 49, showing another modification of the knock button.

FIG. 50 shows an example which is arranged to prevent the slide member from rotating with respect to the barrel. In this example, the internal side of the barrel is formed into an approximately square shape in cross section, and the slide member 80 is formed into a square shape in cross section. Accordingly, the restricting portion 115 of the knock button 72 is formed into a square shape in cross section.

Figure 51:
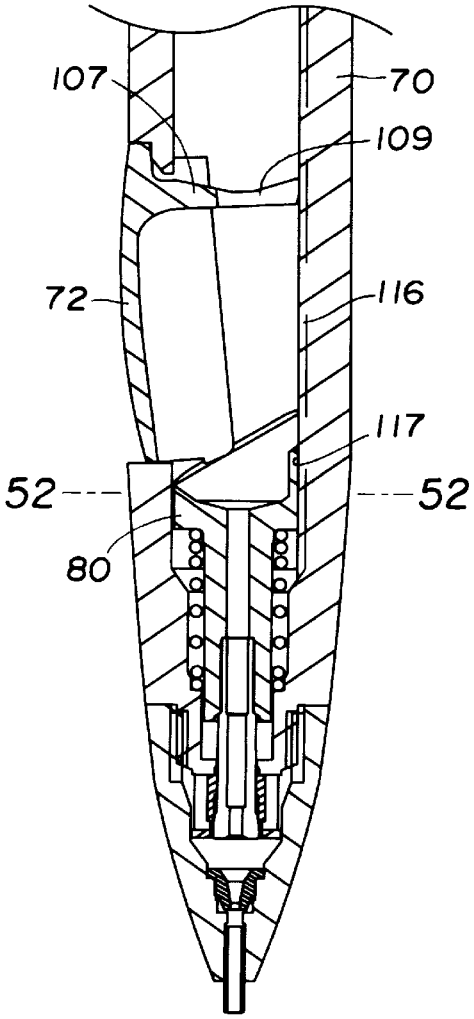
FIG. 51 is a cross-sectional view showing the engagement relationship between the slide member and the barrel.
Figure 52:
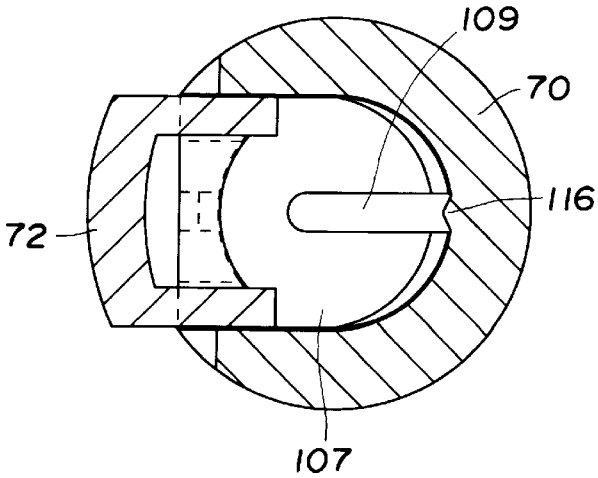
FIG. 52 is a cross-sectional view taken along line 52—52 of FIG. 51.

To prevent the rotation of the slide member 80, a projection 116 may be formed on the internal side of the barrel 70 in which the lead inserting hole 109 is positioned, and a groove 117 which engages with the projection 116 may be formed in the slide member 80 (refer to FIGS. 51 and 52).

Figure 53:
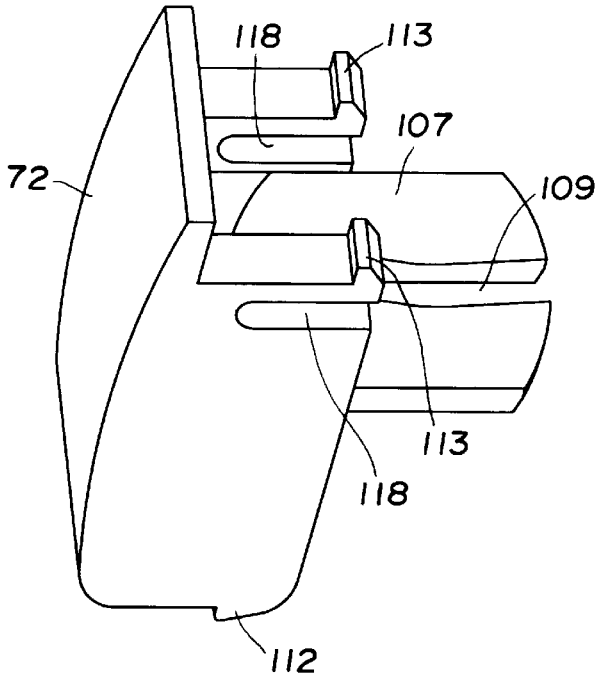
FIG. 53 is a diagrammatic longitudinal sectional view showing still another modification of the knock button.
Figure 54:
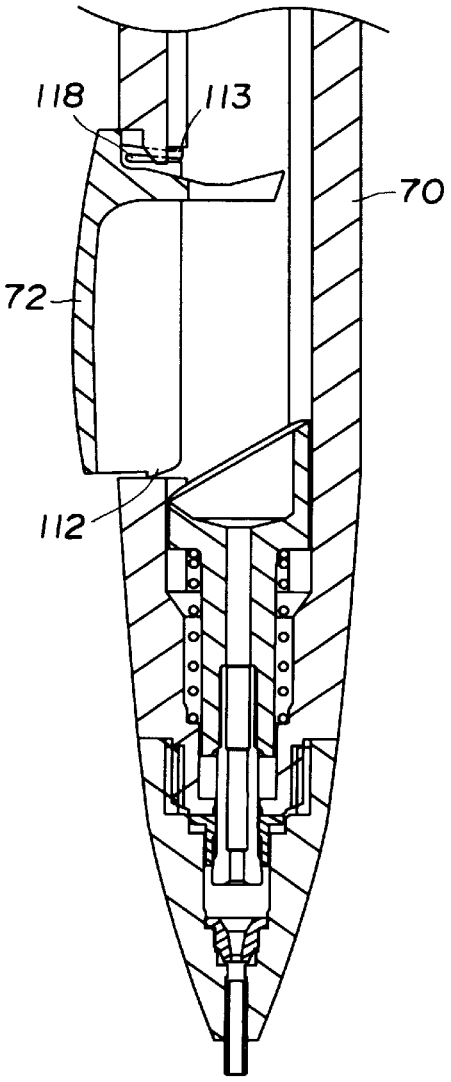
FIG. 54 is a diagrammatic longitudinal sectional view showing the state in which the knock button of FIG. 53 is incorporated.
Figure 55:
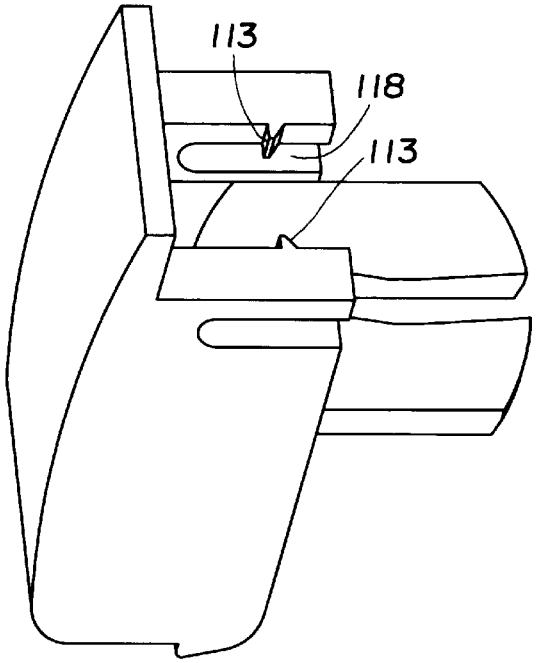
FIG. 55 is a diagrammatic longitudinal sectional view showing still another modification of the knock button.

An example which is intended to facilitate the process of incorporating the knock button into the barrel will be described below. In the example shown in FIG. 53, slits 118 are formed in the rear portion of the knock button 72 to impart elastic force to the respective projections 113 so that the knock button 72 can be easily fitted into the through-hole 71 of the barrel 70 (refer to FIG. 54). When the knock button 72 is fitted into the through-hole 71, a lengthwise play can also be prevented. The slits 118 may also be formed in the front portion of the knock button 72 to impart elastic force to the respective projections 112. The slits 118 may be formed in only the front portion of the knock button 72 to impart elastic force to only the respective projections 112. As shown in FIG. 55, the projections 113 may be formed to project inward of the knock button 72. Accordingly, the positions of the projections or the slits can be arbitrarily selected.

Figure 56:
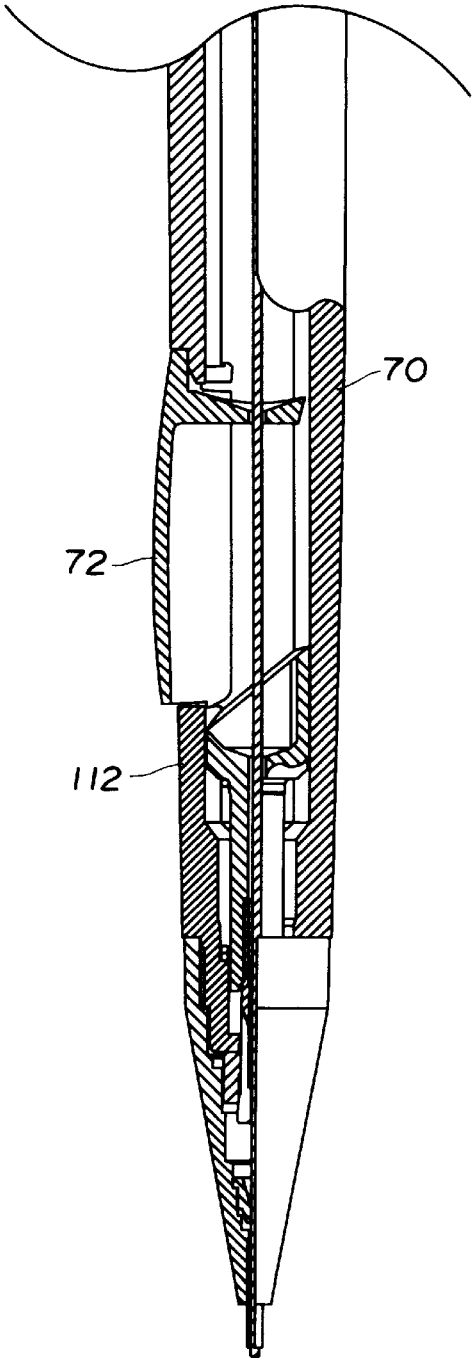
FIG. 56 is a diagrammatic longitudinal sectional view of the state in which the knock button is incorporated.
Figure 57:
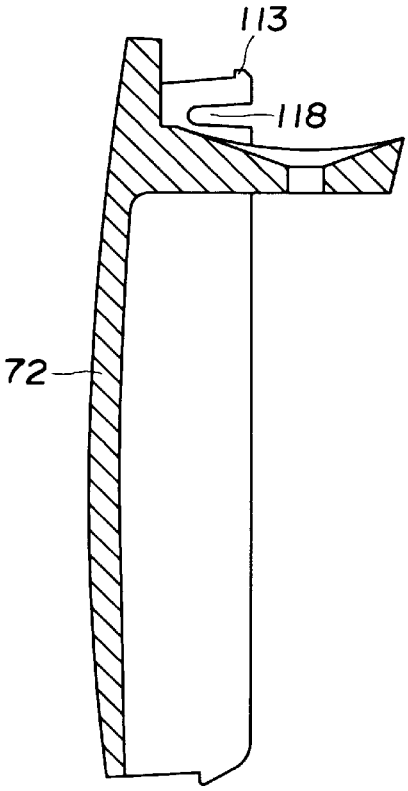
FIG. 57 is a perspective view of the knock button shown in FIG. 56.

FIGS. 56 and 57 shows a modification of the knock button 72. In this modification, the projections 113 to engage with the through-hole 71 of the barrel 70 are formed to project rearward, so that the knock button 72 and the slide member 80 have no contact with each other when the knock button 72 is not pressed. In this modification, although a force always acts on the knock button 72 in the direction in which the knock button 72 is made to come off the barrel 70, the engagement of the projections 112 prevents the knock button 72 from coming off the barrel 70; urging the knock button 72 in the coming-off direction prevents the knock button 72 from shaking. In addition, a pressing distance of the chuck relative to the slide member can be adjusted, so that a reliable lead-gripping force of the chuck can be obtained. Further, a pressing distance of the knock button is increased and, therefore, a good feeling of the pressing operation can be recognized.

According to a first aspect of the present invention, in a side-knock type mechanical pencil in which a lead feeding mechanism is disposed in an inside portion of a barrel and a knock button is disposed in a side portion of the barrel so that the knock button can be pressed inward in a radial direction of the barrel, the knock button being pressed to move the lead feeding mechanism back and forth, thereby feeding a lead from the barrel, a lead inserting portion through which the lead can pass in the direction that the knock button applies a pressure is provided, and the lead inserting portion is formed to have a diameter at least twice as large as the diameter of the lead and at least one lead receiving portion is provided forward of the lead inserting portion. According to a second aspect of the present invention., in a side-knock type mechanical pencil in which a lead feeding mechanism is disposed in an inside portion of a barrel and a knock button is disposed in a side portion of the barrel so that the knock button can be pressed inward in a radial direction of the barrel, the knock button being pressed to move the lead feeding mechanism back and forth, thereby feeding a lead from the barrel, at least one lead receiving portion is provided in a vicinity of the knock button and a lead inserting hole through which the lead can pass is provided in the lead receiving portion, and spaces each having a cross-sectional area larger than the cross-sectional area of the lead inserting portion are formed on opposite sides of the lead receiving portion. Accordingly, it is possible to provide a mechanical pencil which can be inexpensively manufactured but can realize a smooth lead-feeding operation without impairing the essential performance.

What is claimed is:

1. A side-knock type mechanical pencil comprising: a barrel having a front end and a rear end; a lead feeding mechanism disposed in the barrel for axial movement within the barrel to feed a pencil lead toward the front end of the barrel, the lead feeding mechanism having at least one first engagement portion; a knock button disposed in a side portion of the barrel so that the knock button can be pressed inward in a radial direction of the barrel, the knock button having a pair of second engagement portions for sliding engagement with the first engagement portion of the lead feeding mechanism when the knock button is pressed inward to thereby move the lead feeding mechanism axially within the barrel and feed the pencil lead toward the front end of the barrel, each of the second engagement portions having a surface which is oblique relative to a moving direction of the knock button and which slidingly engages the first engagement portion when the knock button is pressed inward, the first engagement portion being disposed between the second engagement portions; a lead passageway for passing therethrough the pencil lead in a direction toward the front end of the barrel; and at least one lead receiving member disposed forwardly of the lead passageway for receiving the pencil lead.

2. A side-knock type mechanical pencil comprising: a barrel having a front end and a rear end; a lead feeding mechanism disposed in the barrel for axial movement within the barrel to feed a pencil lead toward the front end of the barrel; a knock button disposed in a side portion of the barrel for engagement with the lead feeding mechanism so that the knock button can be pressed inward in a radial direction of the barrel to move the lead feeding mechanism axially within the barrel to thereby feed the pencil lead toward the front end of the barrel; at least one lead restricting portion disposed in the barrel in a vicinity of the knock button for receiving the pencil lead, the lead restricting portion having a lead insertion hole for permitting the pencil lead to pass therethrough and a lead receiving portion for receiving the lead prior to passing through the lead insertion hole; and a plurality of lead passageways disposed in the barrel on opposite sides of the lead restricting portion for receiving the pencil lead, each of the lead passageways having an inner cross-sectional area larger than a cross-sectional area of the lead insertion hole of the lead restricting portion.

3. A side-knock type mechanical pencil according to claim 2; wherein the lead feeding mechanism has at least one first engagement portion, and the knock button has at least one second engagement portion for sliding engagement with the first engagement portion, the second engagement portion having a surface which is oblique relative to a moving direction of the knock button and which slidingly engages the first engagement portion when the knock button is pressed inward.

4. A side-knock type mechanical pencil according to claim 3; wherein the at least one first engagement portion of the lead feeding mechanism comprises two first engagement portions; and wherein the at least one second engagement portion of the knock button comprises two second engagement portions each having an oblique surface for respective sliding engagement with respective ones of the two first engagement portions of the lead feeding mechanism when the knock button is pressed inward.

5. A side-knock type mechanical pencil according to claim 4; wherein each of the first engagement portions of the lead feeding mechanism has a surface which is oblique relative to a moving direction of the lead feeding mechanism and which respectively engage the oblique surfaces of the second engagement portions of the knock button when the knock button is pressed inward.

6. A side-knock type mechanical pencil according to claim 2; wherein the lead insertion hole of the lead receiving member has a diameter for permitting only one pencil lead to pass therethrough.

7. A side-knock type mechanical pencil according to claim 2; wherein the lead receiving member has a head portion disposed rearwardly of the knock button in the direction of the front end of the barrel, the head portion having an external diameter approximately equal to an internal diameter of the barrel.

8. A side-knock type mechanical pencil according to claim 7; wherein the lead feeding mechanism comprises a tubular member disposed in the barrel for axial movement within the barrel.

9. A side-knock type mechanical pencil according to claim 8; wherein the lead feeding mechanism further comprises at least one engagement portion integrally mounted on an outer peripheral surface of the tubular member for engagement with the knock button when the knock button is pressed inward.

10. A side-knock type mechanical pencil according to claim 8; wherein the lead receiving member and the tubular member comprise a unitary structure formed from a single piece of material.

11. A side-knock type mechanical pencil according to claim 8; wherein the lead receiving member is integrally connected to an end of the tubular member.

12. A side-knock type mechanical pencil according to claim 11; wherein the lead receiving member is connected to an inner peripheral surface portion of the tubular member by press fit.

13. A side-knock type mechanical pencil according to claim 1; wherein the at least one first engagement portion of the lead feeding mechanism comprises two first engagement portions; and wherein the at least one second engagement portion of the knock button comprises two second engagement portions each having an oblique surface for sliding engagement with respective ones of the two first engagement portions of the lead feeding mechanism when the knock button is pressed inward.

14. A side-knock type mechanical pencil according to claim 13; wherein each of the first engagement portions of the lead feeding mechanism has a surface which is oblique relative to a moving direction of the lead feeding mechanism and which respectively engage the oblique surfaces of the second engagement portions of the knock button when the knock button is pressed inward.

15. A side-knock type mechanical pencil according to claim 1; wherein the first engagement portion of the lead feeding mechanism has a surface which is oblique relative to a moving direction of the lead feeding mechanism and which engages the oblique surface of the second engagement portion of the knock button when the knock button is pressed inward.

16. A side-knock type mechanical pencil comprising: a barrel having a front end and a rear end; a lead feeding mechanism having a tubular member disposed in the barrel for axial movement within the barrel to feed a pencil lead toward the front end of the barrel, the tubular member having a first end and a second end; a knock button disposed in a side portion of the barrel so that the knock button can be pressed inward in a radial direction of the barrel to move the tubular member axially within the barrel to thereby feed the pencil lead toward the front end of the barrel; a lead passageway disposed in the barrel for passing therethrough the pencil lead in a direction toward the front end of the barrel, the first end of the tubular member being closer to the lead passageway than the second end of the tubular member; and at least one lead receiving member disposed in the barrel for receiving the pencil lead and integrally connected to the first end of the tubular member, the lead receiving member having a lead insertion hole for permitting the pencil lead to pass therethrough and into the tubular member and a head portion having an external diameter approximately equal to an internal diameter of the barrel.

17. A side-knock type mechanical pencil according to claim 16; wherein the lead insertion hole of the lead receiving member has a diameter for permitting only one pencil lead at a time to pass therethrough.

18. A side-knock type mechanical pencil according to claim 16; wherein the lead feeding mechanism further comprises at least one engagement portion integrally mounted on an outer peripheral surface of the tubular member for engagement with the knock button when the knock button is pressed inward.

19. A side-knock type mechanical pencil according to claim 16; wherein the lead receiving member and the tubular member comprise a unitary structure formed from a single piece of material.

20. A side-knock type mechanical pencil according to claim 16; wherein the lead receiving member is connected to an inner peripheral surface portion of the tubular member by press fit.

21. A side-knock type mechanical pencil comprising:

a tubular body having a front end, a rear end and a storage section for storing pencil leads;

a first tubular member mounted within the tubular body for axial movement along a lengthwise direction of the tubular body, the first tubular member having a lead passageway for receiving a pencil lead from the storage section of the tubular body;

a second tubular member integrally connected to an end of the first tubular member for axial movement therewith, the second tubular member having a head portion and a tubular body portion having an external diameter smaller than an external diameter of the head portion, the head portion and the tubular body portion having a through-hole for permitting only one of the pencil leads from the storage section of the tubular body to pass therethrough and into the lead passageway of the first tubular member;

a knock member mounted in a side portion of the tubular body for movement in a direction generally perpendicular to the lengthwise direction of the tubular body; and means interconnecting the knock member and the first tubular member when the knock member is moved in the direction generally perpendicular to the lengthwise direction of the tubular body for moving the first and second tubular members axially within the tubular body to thereby feed the pencil lead in the passageway of the first tubular member toward the front end of the tubular body.

22. A side-knock type mechanical pencil according to claim 21; wherein the external diameter of the head portion of the second tubular member has a dimension relative to an internal diameter of the tubular body such that the first and second tubular members are permitted to move axially within the tubular body when the knock member is moved in the direction generally perpendicular to the lengthwise direction of the tubular body while the head portion guides the first and second tubular members to prevent substantial movement of the first and second tubular members in the lengthwise direction of the tubular body.

23. A side-knock type mechanical pencil according to claim 22; wherein the head portion of the second tubular member is generally cone-shaped.

24. A side-knock type mechanical pencil according to claim 21; wherein the head portion of the second tubular member is generally cone-shaped.

25. A side-knock type mechanical pencil according to claim 21; wherein the interconnecting means comprises at least one engagement member integrally mounted on the first tubular member for movement therewith, and an engagement portion of the knock button slidably engagable with the engagement member when the knock button is moved in the direction generally perpendicular to the lengthwise direction of the tubular body.

26. A side-knock type mechanical pencil according to claim 25; wherein each of the engagement member and the engagement portion of the knock member has a surface which is oblique relative to the lengthwise direction of the tubular body, the oblique surfaces being in sliding engagement with one another when the knock button is moved in the direction generally perpendicular to the lengthwise direction of the tubular body.

27. A side-knock type mechanical pencil according to claim 21; wherein the interconnecting means comprises a pair of engagement members integrally mounted on the first tubular member for movement therewith, and a pair of engagement portions of the knock button for respective sliding engagement with the engagement members when the knock button is moved in the direction generally perpendicular to the lengthwise direction of the tubular body.

28. A side-knock type mechanical pencil according to claim 27; wherein each of the engagement members and each of the engagement portions of the knock member has a surface which is oblique relative to the lengthwise direction of the tubular body, the oblique surfaces of each of the engagement members being in respective sliding engagement with the oblique surfaces of the engagement portions of the knock member when the knock button is moved in the direction generally perpendicular to the lengthwise direction of the tubular body.

29. A side-knock type mechanical pencil according to claim 21; wherein the first and second tubular members comprise a unitary structure formed from a single piece of material.

30. A side-knock type mechanical pencil according to claim 29; wherein the head portion of the second tubular member is generally cone-shaped.

31. A side-knock type mechanical pencil according to claim 21; wherein the tubular body portion of the second tubular member is connected to the first tubular member by a press fit.

32. A side-knock type mechanical pencil according to claim 31; wherein the tubular body portion of the second tubular member has an internal diameter smaller than an internal diameter of the first tubular member.

33. A side-knock type mechanical pencil according to claim 32; wherein the head portion of the second tubular member is generally cone-shaped.

34. A side-knock type mechanical pencil according to claim 21; further comprising a chuck member connected to an end of the first tubular member opposite the end thereof to which the second tubular member is connected, the chuck member being configured and disposed to advance a pencil lead disposed in the lead passageway out of the front end of the tubular body when the knock button is moved in the direction generally perpendicular to the lengthwise direction of the tubular body.

35. A side-knock type mechanical pencil according to claim 34; further comprising a biasing member disposed within the tubular body for biasing the chuck member, the first tubular member and the second tubular member toward the rear end of the tubular body.

36. A side-knock type mechanical pencil comprising: a barrel having a front end and a rear end; a lead feeding mechanism disposed in the barrel for axial movement within the barrel to feed a pencil lead toward the front end of the barrel, the lead feeding mechanism having a pair of first engagement portions; a knock button disposed in a side portion of the barrel so that the knock button can be pressed inward in a radial direction of the barrel, the knock button having a pair of second engagement portions for sliding engagement with the first engagement portions of the lead feeding mechanism when the knock button is pressed inward to thereby move the lead feeding mechanism axially within the barrel and feed the pencil lead toward the front end of the barrel, the second engagement portions having a surface which is oblique relative to a moving direction of the knock button and which slidingly engage the first engagement portions when the knock button is pressed inward, one of the second engagement portions slidingly engaging both of the first engagement portions when the knock button is pressed inward; a lead passageway for passing therethrough the pencil lead in a direction toward the front end of the barrel; and at least one lead receiving member disposed forwardly of the lead passageway for receiving the pencil lead.

37. A side-knock mechanical pencil according to claim 36; wherein one of the first engagement portions is disposed between the second engagement portions.

38. A side-knock mechanical pencil according to claim 16; wherein the lead passageway has a diameter at least twice as large as a diameter of the pencil lead.

* * * * *